US005389007A

United States Patent [19]

Reinelt

[11] Patent Number: 5,389,007

[45] Date of Patent: Feb. 14, 1995

[54] CONNECTOR BLOCK ASSEMBLY

[75] Inventor: Ernest Reinelt, Laguna Niguel, Calif.

[73] Assignee: Eaton Corporation, Cleveland, Ohio

[21] Appl. No.: 90,661

[22] Filed: Jul. 13, 1993

[51] Int. Cl.[6] ..... H01R 13/627

[52] U.S. Cl. ..... 439/357; 439/350

[58] Field of Search ..... 439/350–358, 439/682, 692, 693, 787

[56] References Cited

U.S. PATENT DOCUMENTS

| | | | |
|---|---|---|---|
| 3,179,738 | 4/1965 | Lyon | 439/350 |
| 3,430,184 | 2/1969 | Acord | 439/350 |
| 3,560,908 | 2/1971 | Dell et al. | 439/353 |
| 4,580,863 | 4/1986 | Lohr et al. | 439/787 |
| 4,731,030 | 3/1988 | Johnson | 439/351 |
| 5,069,634 | 12/1991 | Chiarolanzio | 439/353 |

OTHER PUBLICATIONS

Advertising Brochure published in 1992 and entitled "Series 584 Sunlight–Readable Avionics Switch".

*Primary Examiner*—David L. Pirlot
*Assistant Examiner*—Hien D. Vu
*Attorney, Agent, or Firm*—Tarolli, Sundheim & Covell

[57] ABSTRACT

Upper and lower connector sections of a connector block assembly have contact cavities which receive electrical contacts. A pair of resiliently deflectable retainer fingers engage latch flanges disposed in retainer cavities. The retainer fingers have a nonuniform cross sectional configuration. The nonuniform cross sectional configuration of the retainer fingers enables the retainer fingers and the retainer cavities to fit into a dense array of contact cavities formed in the upper and lower connector sections. In addition, the nonuniform cross sectional configuration of the retainer fingers enable them to be resiliently deflected by the latch flanges without breaking. As the connector sections are interconnected, alignment collars extending from a side of one of the connector sections move into recesses formed in the other connector section to accurately align the contact cavities.

66 Claims, 6 Drawing Sheets

CONNECTOR BLOCK ASSEMBLY

BACKGROUND OF THE INVENTION

The present invention relates to a connector block assembly for use in interconnecting electrical conductors.

Known connector block assemblies are used to interconnect electrical conductors in many different types of environments. Commercially available switch assemblies may contain connector block assemblies. Known switch assemblies which contain connector block assemblies are commercially available from Eaton Corporation, Aerospace Controls Division of Costa Mesa, Calif. and are designated as the Eaton Series 584 family of switches.

These known switches have been satisfactory in their design and operation. The compact design of connector block assemblies in these known switches enables as many as eighteen electrical contact terminals to interconnect eighteen separate pairs of electrical conductors. The connector block assemblies used in these known switches have previously been formed of two sections which are interconnected by a pair of screws and/or epoxy. The two sections of a known connector block assembly may be interconnected with a slight misalignment of the electrical contact cavities in the connector block assembly. This can lead to splitting of a portion of the connector block assembly and/or difficulty in interconnecting electrical contacts.

SUMMARY OF THE INVENTION

The present invention relates to a new and improved connector block assembly for use in interconnecting electrical conductors. The connector block assembly includes a pair of connector sections in which contact cavities are formed. A resiliently deflectable retainer finger extends outward from one of the connector sections and is received in a retainer cavity in the other connector section.

The resiliently deflectable retainer finger has a body section and a head end section. The head end section of the retainer finger has a latch surface. The latch surface on the retainer finger engages a latch surface on a latch flange formed in the retainer cavity to interconnect the two sections of the connector block assembly.

The body section of the retainer finger has a longitudinally extending central portion which is thicker than longitudinally extending side portions of the retainer finger. The relatively thick central portion of the retainer finger enhances the strength of the retainer finger and enables it to be fitted into an array of contact cavities.

In order to promote accurate alignment of the contact cavities, alignment collars project outward from one of the connector sections. The alignment collars are received in alignment recesses in the other connector section. The alignment collars and recesses accurately position the contact cavities in the two connector sections relative to each other.

BRIEF DESCRIPTION OF THE DRAWINGS

The foregoing and other features of the invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
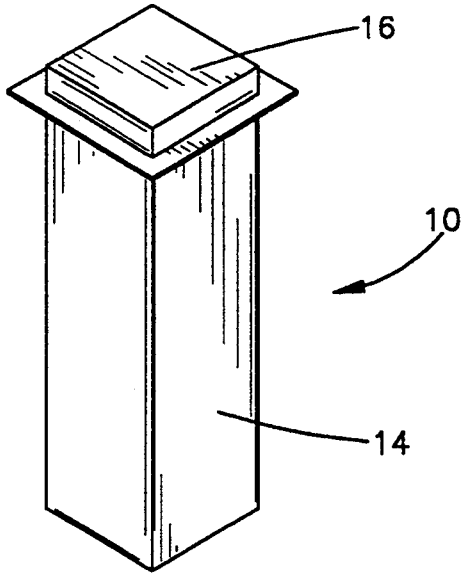
FIG. 1 is a pictorial illustration of a switch assembly.

A switch assembly 10 (FIG. 1) contains a connector block assembly 12 (FIG. 2) constructed in accordance with the present invention. It should be understood that the connector block assembly 12 may be used in many different environments other than in association with the switch assembly 10. The switch assembly 10 includes a rectangular housing 14 (FIG. 1) which encloses the connector block assembly 12 and a manually actuatable pushbutton 16.

The connector block assembly 12 (FIG. 2) connects upper electrical conductors 20 with lower electrical conductors 22. The connector block assembly 12 includes an upper connector section 26 and a lower connector section 28. In accordance with one of the features of the present invention, retainer fingers 32 and 34 interconnect the upper and lower connector sections 26 and 28. Thus, the retainer fingers 32 and 34 are formed as one piece with the upper connector section 26 and engage latch flanges 38 and 40 formed in retainer cavities 42 and 44 in the lower connector section 28. Engagement of the retainer fingers 32 and 34 with the latch flanges 38 and 40 hold the upper and lower connector sections against movement relative to each other.

An electrical contact or terminal 48, having a known construction, is disposed in a contact cavity 50 in the upper connector section 26. The electrical contact 48 is connected with one of the conductors 20 in a known manner. Although only one electrical contact 48 has been shown in only one contact cavity 50 in the upper connector section 26, it should be understood that there are a plurality of electrical contacts disposed in a plurality of contact cavities formed in the upper connector section.

In addition, an electrical contact or terminal 54, having a known construction, is disposed in a contact cavity 56 in the lower connector section 28. The electrical contact 54 is connected with one of the conductors 22 in a known manner. Although only one electrical contact 54 has been shown in only one contact cavity 56 in the lower connector section 28, it should be understood there are that a plurality of electrical contacts disposed in a plurality of contact cavities formed in the lower connector section. The upper and lower electrical contacts 48 and 54 cooperate with each other to electrically interconnect conductors 20 and 22 in a known manner.

In accordance with another of the features of the present invention, an alignment collar 60 extends from the upper contact section 26 and engages an alignment recess 62 in the lower connector section 28. Although only a single alignment collar 60 and alignment recess 62 has been shown in FIG. 2, it should be understood that a plurality of alignment collars are provided on the upper connector section 26 to engage a plurality of alignment recesses 62 in the lower connector section 28. Thus, there is an alignment collar 60 and an alignment recess 62 associated with each set of upper and lower contact cavities 50 and 56. The alignment collars 60 and recesses 62 make certain that the contact cavities 50 and 56 are accurately aligned with each other when the upper and lower connector sections 26 and 28 are connected.

Figure 2:
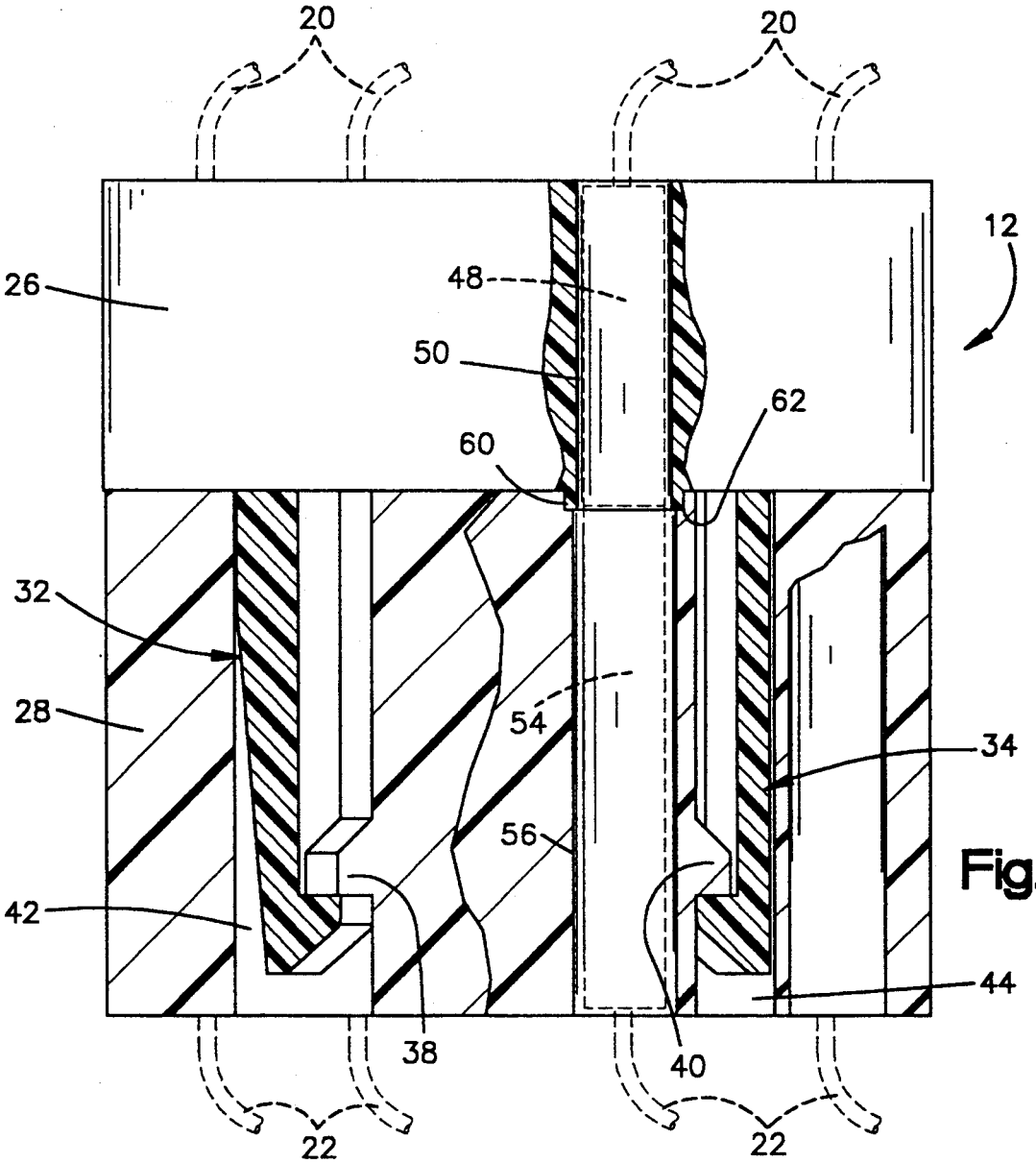
FIG. 2 is an enlarged broken away and simplified schematic illustration of a connector block assembly which is constructed in accordance with the present invention and forms part of the .switch assembly of FIG. 1.

Although only four upper wires or conductors 20 and four lower wires or conductors 22 have been shown in FIG. 2, it should be understood that there could be a substantially greater number of conductors associated with the connector block assembly 12. Thus, in one specific embodiment of the invention, there were eighteen upper conductor wires 20 which were electrically interconnected with eighteen lower wires or conductors 22 by the connector block assembly 12. Although the electrical conductors 20 and 22 have been shown in FIG. 2 as being wires, it is contemplated that they could be rigid pins or other types of conductors.

In the embodiment of the invention illustrated in FIG. 2, the alignment collars 60 extend from the upper connector section 26 along with the retainer fingers 32 and 34. However, it is contemplated that the alignment collars 60 could extend from the lower connector section 28 if desired. Of course, if this was done, the alignment recesses 62 would be formed in the upper connector section 26.

Upper Connector Section

The upper connector section 26 (FIGS. 3 and 4) is formed of one piece of polymeric material. Although many different kinds of material could be utilized if desired, in one specific embodiment of the invention, the upper connector section 26 was molded as one piece of LCP, Vectra A515 (trademark) available from Celanese Corporation.

Figure 3:
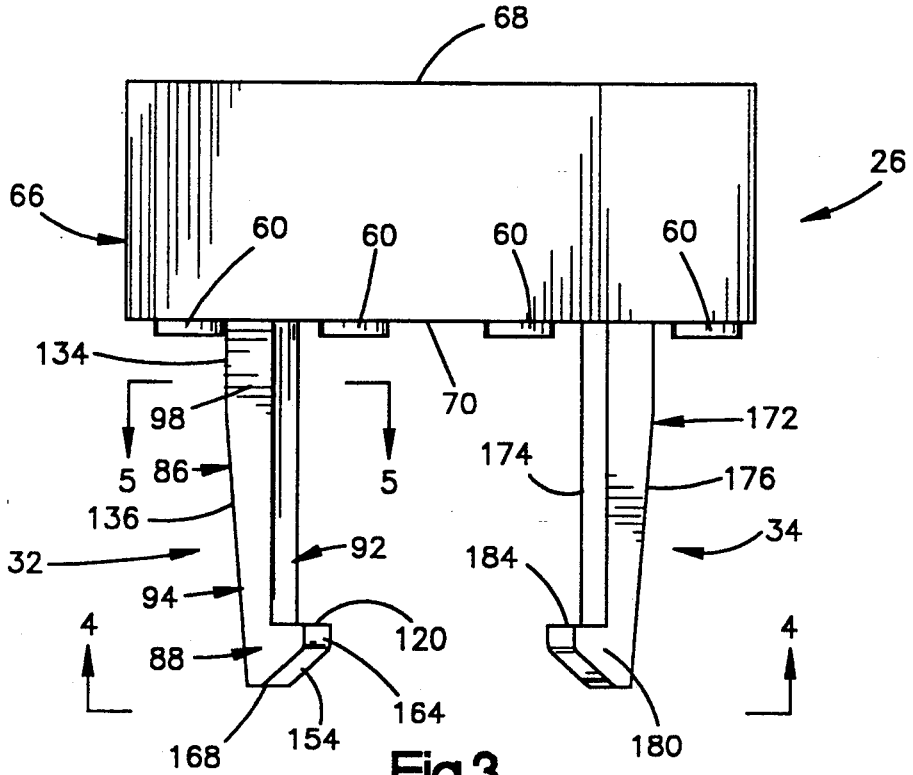
FIG. 3 is a side elevational view of an upper connector section of the connector block assembly of FIG. 2.
Figure 4:
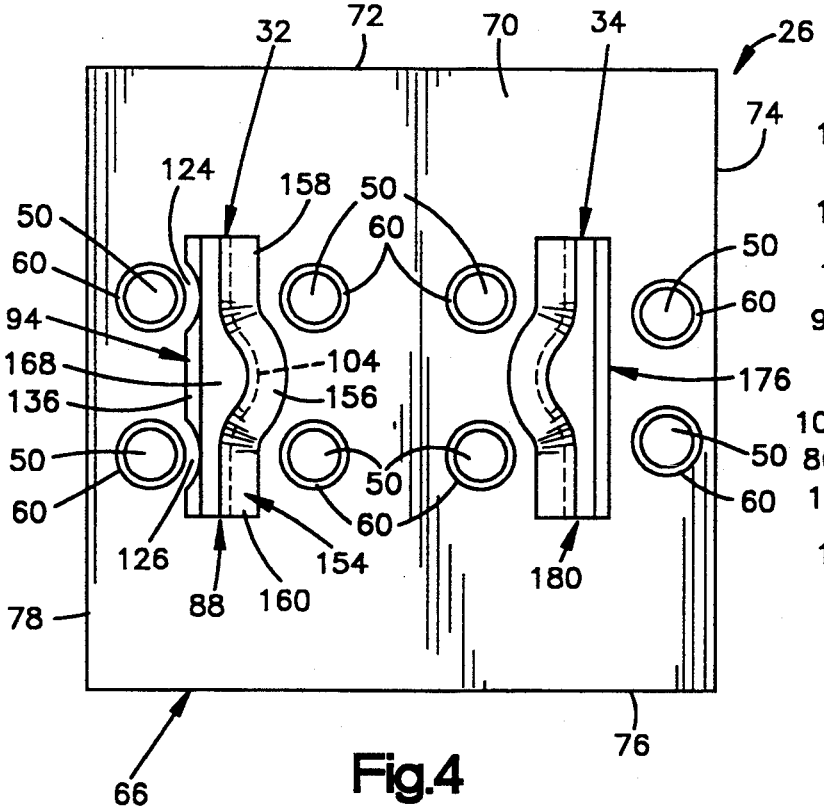
FIG. 4 is a bottom plan view, taken generally along the line 4—4 of FIG. 3.

The one-piece upper connector section 26 has a rectangular body 66. The rectangular body 66 has parallel upper and lower end surfaces 68 and 70 (FIG. 3). The upper and lower end surfaces 68 and 70 are interconnected by side surfaces 72, 74, 76, and 78 (FIG. 4). Although it is preferred to form the body 66 with a rectangular configuration, it should be understood that the body 66 could be formed with a different configuration if desired.

A plurality of generally cylindrical contact cavities 50 (FIG. 4) extend through the rectangular body 66 between the upper and lower end surfaces 68 and 70. The contact cavities 50 have parallel central axes which extend perpendicular to the end surfaces 68 and 70 and parallel to a central axis of the rectangular body 66. Although only eight contact cavities 50 have been shown in FIG. 4, it should be understood that the rectangular body 66 could be formed with any desired number of contact cavities. The specific configuration of the contact cavities 50 will depend upon the construction of the electrical contacts to be mounted in the contact cavities.

An annular alignment collar 60 (FIGS. 3 and 4) is associated with each of the contact cavities 50. The alignment collars 60 extend axially downward (as viewed in FIG. 3) from the lower end surface 70 of the rectangular body 66. Of course, the alignment collars 60 could have a configuration other than the annular configuration illustrated in FIG. 4.

The left and right retainer fingers 32 and 34 extend from and are molded as one piece with the rectangular body 66. The retainer fingers 32 and 34 are resiliently deflectable relative to the rectangular body 66 to enable the retainer fingers to engage the latch flanges 38 and 40 (FIG. 2) in the lower connector section 28. The retainer fingers 32 and 34 (FIG. 3) have parallel longitudinal central axes which extend perpendicular to the lower end surface of the rectangular body 66.

Figure 5:
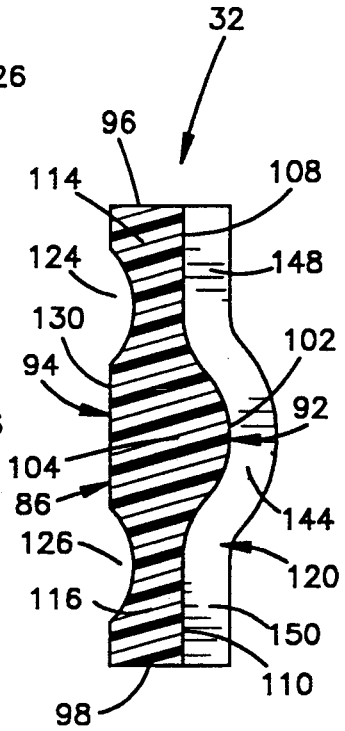
FIG. 5 is an enlarged sectional view, taken generally along the line 5—5 of FIG. 3, illustrating the cross sectional configuration of a body section of a retainer finger on the upper connector section.

The left retainer finger 32 includes a longitudinally extending body section 86 (FIGS. 3 and 5). The body section 86 extends downwardly from the rectangular body 66 (FIG. 3) and is resiliently deflectable relative to the body 66. A head end section 88 is formed at the lower (as viewed in FIG. 3) end of the body section 86.

The body section 86 of the left retainer finger 32 includes a front side surface 92 and a rear side surface 94. Parallel flat end surfaces 96 and 98 (FIG. 5) interconnect the front and rear side surfaces 92 and 94. The central axes of the body section 86, the front side surface 92 and end surfaces 96 and 98 all extend perpendicular to the lower end surface 70 (FIG. 3) of the rectangular body 66 of the upper connector section 26 throughout their length.

The body section 86 of the retainer finger 32 has a nonuniform thickness as viewed in a cross sectional plane (FIG. 5). This enables the retainer finger 32 to fit between contact cavities 50 (FIG. 4) in the rectangular body 66. The nonuniform thickness of the body section 86 of the retainer finger 32 also enables the strength of the retainer finger to be maximized while still allowing the retainer finger to fit between the contact cavities 50.

The relatively strong body section 86 of the retainer finger 32 enables the retainer finger to be resiliently deflected by the latch flange 38 (FIG. 2) without breaking. In addition, the variations in the thickness of the retainer finger body section 86 enable the retainer finger 32 to withstand substantial axial forces which tend to pull the upper connector section 26 away from the lower connector section 28. The variations in the cross sectional thickness of the retainer finger 32 enable the retainer finger to be relatively strong and still fit into a very dense array of contact cavities 50.

The front side surface 92 (FIG. 3) of the left retainer finger 32 faces toward the retainer finger 34 and has a continuously curving central portion 102 (FIG. 5). The arcuately outward curving or convex central portion 102 of the front side surface 92 tends to maximize the distance between the front side surface 92 and the rear side surface 94 at a central portion 104 of the body section 86. This results in the central portion 104 of the body section 86 being relatively thick and strong.

The arcuately outwardly curving central portion 104 of the body section 86 projects toward and is aligned with the space between contact cavities 50 (FIG. 4). The arcuately outwardly curving central portion 104 of the body section 86 projects toward a plane containing longitudinal central axes of an adjacent pair of contact cavities 50. The arcuately outwardly curving and continuous central portion 102 of the front side surface 92 (FIG. 5) is free of discontinuities to minimize stress concentrations in the body section 86 of the left retainer finger 32.

The front side surface 92 includes linear side portions 108 and 110 (FIG. 5) which are disposed along opposite sides of the central portion 102 of the front side surface. The linear side portions 108 and 110 are disposed in a common plane which extends perpendicular to the lower end surface 70 of the rectangular body 66.

The body section 86 of the left retainer finger 32 has relatively thin side portions 114 and 116 (FIG. 5). The relatively thin side portions 114 and 116 are disposed along opposite sides of the relatively thick central portion 104 of the body section 86. The relatively thin side portions 114 and 116 of the body section 86 of the left retainer finger 32 can fit into a limited space between adjacent contact cavities 50 (FIG. 4). In addition, the relatively thin side portions 114 and 116 (FIG. 5) of the body section 86 cooperate with the relatively thick central portion 104 of the body section to increase the ability of the retainer finger 32 to withstand sideward deflection forces without breaking.

The entire front side surface 92 is free of stress inducing discontinuities. This minimizes the formation of stress concentrations in the retainer finger 32. The front side surface 92 extends from a flat latch surface 120 (FIG. 3) on the head end section 88 to the lower end surface 70 on the rectangular body 66.

A pair of longitudinally extending recesses or grooves 124 and 126 (FIG. 5) are formed in the rear side surface 94. The longitudinally extending grooves 124 and 126 are formed in the body section 86 to enable the body section to fit between closely adjacent contact cavities 50 (FIG. 4) without interfering with the connection of conductors with electrical contacts or terminals in the cavities. The longitudinally extending grooves 124 and 126 extend from the lower end surface 70 (FIG. 3) of the rectangular body 66 outward to the head end section 88 of the retainer finger 32. A flat side surface area 130 (FIG. 5) is formed between the grooves 124 and 126.

Figure 8:
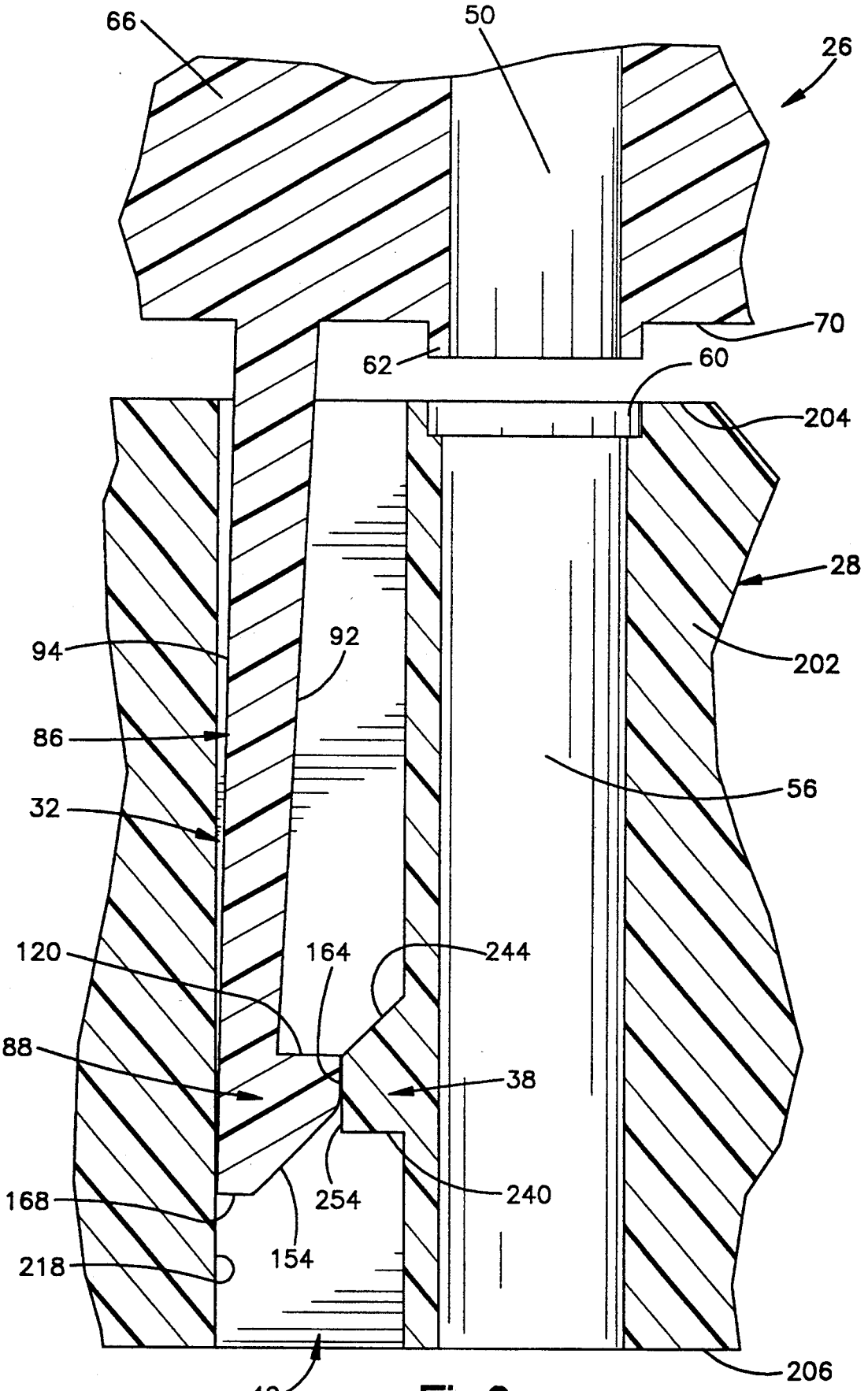
FIG. 8 is an enlarged and simplified schematic illustration of the manner in which a retainer finger is inserted into a retainer cavity as the upper and lower connector sections of the connector block assembly of FIG. 2 are interconnected.
Figure 9:
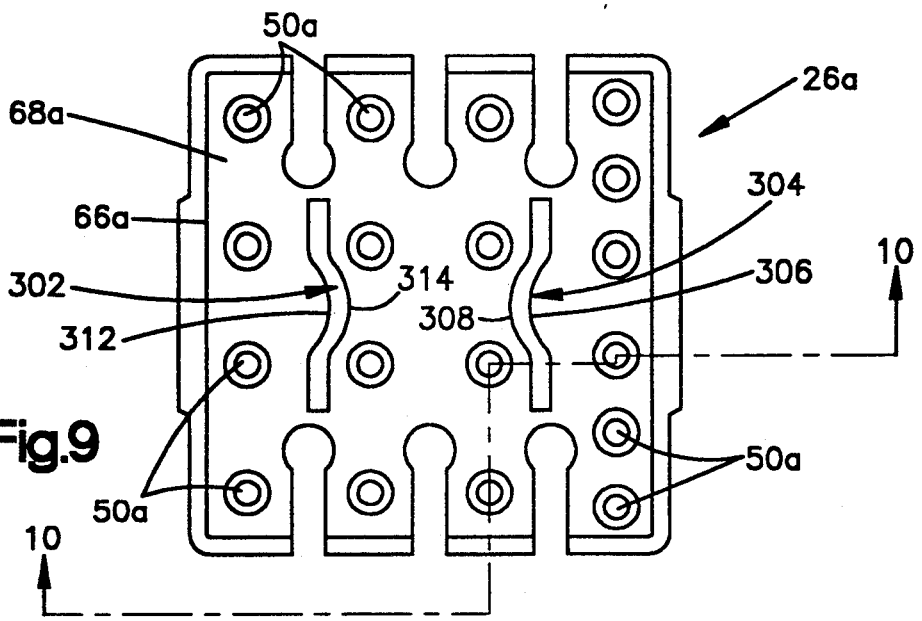
FIG. 9 is a top plan view of an upper connector section of one specific embodiment of the invention.

The body section 86 of the retainer finger 32 is relatively thick adjacent to the rectangular body 66 (FIG. 3) and is relatively thin adjacent to the head end section 88. Thus, the rear side surface 94 has a base portion 134 which extends perpendicular to the lower end surface 70 of the rectangular body 66. The rear side surface 94 also has a sloping portion 136 which is skewed at an acute angle relative to the lower end surface 70 of the rectangular body 66. This results in the lower portion (as viewed in FIG. 3) of the retainer finger being somewhat thinner than the upper portion of the retainer finger. Therefore, the head end section 88 of the retainer finger 34 can move through a relatively limited amount of space adjacent to a latch flange 38 (FIG. 8).

The head end section 88 (FIGS. 3 and 4) has a configuration, when viewed in a plane extending parallel to the lower end surface 70 of the rectangular body 66, which corresponds to the configuration of the body section 86 of the retainer finger 32. The latch surface 120 (FIGS. 3 and 5) is formed on the head end section 88. The latch surface 120 is disposed in flat abutting engagement with the latch flange 38 when the retainer finger 32 is disposed in the retainer cavity 42 (FIG. 2).

The flat latch surface 120 (FIG. 5) extends outward from the front side surface 92 of the body section 86 for a uniform distance throughout the length of the latch surface. Therefore, the latch surface 120 has a configuration which corresponds to the configuration of the front side surface 92 of the body section 86. Thus, the flat latch surface 120 includes a continuously curving central portion 144, as viewed in FIG. 5, with the same radius of curvature as the central portion 102 of the front surface 92. The continuously curving central portion 144 of the flat latch surface 120 projects outward toward the plane containing longitudinal central axes of an adjacent pair of contact cavities 50. The latch surface 120 has a pair of side portions 148 and 150 which are disposed on opposite sides of the central portion 144. The side portions 148 and 150 of the latch surface 120 have a linear configuration, as viewed in FIG. 5.

The entire latch surface 120 is disposed in a flat plane which extends perpendicular to the longitudinal central axis of the body section 86 and to the central axis of the rectangular body 66. When the left retainer finger 32 is inserted into the retainer cavity 42 (FIG. 2) the latch surface 120 is disposed in flat abutting engagement with the latch flange 38 throughout the extent of the latch surface 120.

A sloping cam surface 154 (FIGS. 3 and 4) is formed on the side of the head end section 88 opposite from the latch surface 120. The cam surface 154 (FIG. 4) has a configuration which corresponds to the configuration of the latch surface 120. Thus, the cam surface 154 has a continuously curving central portion 156 with the same configuration as the central portion 144 of the latch surface 120 and the same configuration as the central portion 102 of the front side surface 92 on the body section 86.

The cam surface 154 has a pair of side portions 158 and 160 which are disposed on opposite sides of the center portion 156 and have a linear configuration. The side portions 158 and 160 are disposed in a flat plane which is skewed at an acute angle, approximately 45°, to the longitudinal central axis of the body section 86 and to the longitudinal central axis of the rectangular body 66 (FIG. 3). When the left retainer finger 32 is inserted into the retainer cavity 42 (FIG. 2), the cam surface 154 moves into sliding engagement with the latch flange 38. Engagement of the cam surface 154 with the latch flange 38 deflects the retainer finger 32 toward the left (as viewed in FIG. 2).

The head end section 88 of the left retainer finger 32 has a nose surface 164 (FIG. 3) which extends between the latch surface 120 and the cam surface 154. The nose surface 120 has the same configuration as the front side surface 92 on the body section 86 of the left retainer finger 32. However, the nose surface 164 is offset from the front side surface 92 of the body section by the width of the latch surface 120.

An end surface 168 (FIGS. 3 and 4) interconnects the cam surface 154 and the rear side surface 94. The end surface 168 extends parallel to the lower end surface 70 on the rectangular body 66 of the upper connector section 26. In addition, the end surface 168 extends parallel to the latch surface 120.

The right retainer finger 34 has the same general construction and configuration as the left retainer finger 32. However, the right retainer finger 34 faces in the opposite direction from the left retainer finger 32. Thus, the right retainer finger 34 has a body section 172 (FIG. 3) with a front side surface 174 which faces toward the front side surface 92 on the left retainer finger 32. The body section 172 has a rear side surface 176 which faces away from the left retainer finger 32. A head end section 180 on the right retainer finger 34 projects toward the head end section 88 on the left retainer finger 32. A latch surface 184 on the head end section 180 of the right retainer finger 34 is disposed in the same plane as the latch surface 120 on the head end section 88 of the left retainer finger 32.

Other than facing in opposite directions, that is toward each other, the left and right retainer fingers 32 and 34 have the same construction. However, the rear surface 176 of the right retainer finger 34 does not have grooves corresponding to the grooves 124 and 126 in the rear side surface 94 of the left retainer finger 32. Thus, the rear side surface 176 on the right retainer finger 34 is flat and free of grooves corresponding to the grooves 124 and 126.

The reason that the rear side surface 176 of the right retainer finger 34 does not have grooves corresponding to the grooves 124 and 126 in the rear side surface 94 of the left retainer finger 32 is that there is greater clearance between the contact cavities 50 around the right retainer finger 34 than there is around the left retainer finger 32 (FIG. 4). If the contact cavities 50 to the right of the retainer finger 34 were closer to the retainer finger (FIG. 4), it would be necessary to provide longitudinally extending grooves in the rear side surface 176 of the retainer finger 34.

Lower Connector Section

The lower connector section 28.(FIGS. 6 and 7) is formed of one piece of polymeric material. Although the lower connector section 28 could be formed of many different materials, the lower connector section 28 may be molded as one piece of LCP, Vectra A515 (Trademark) which is commercially available from Celanese Corporation. Of course, the lower connector section 28 could be molded from one piece of many different types of polymeric material.

Figure 6:
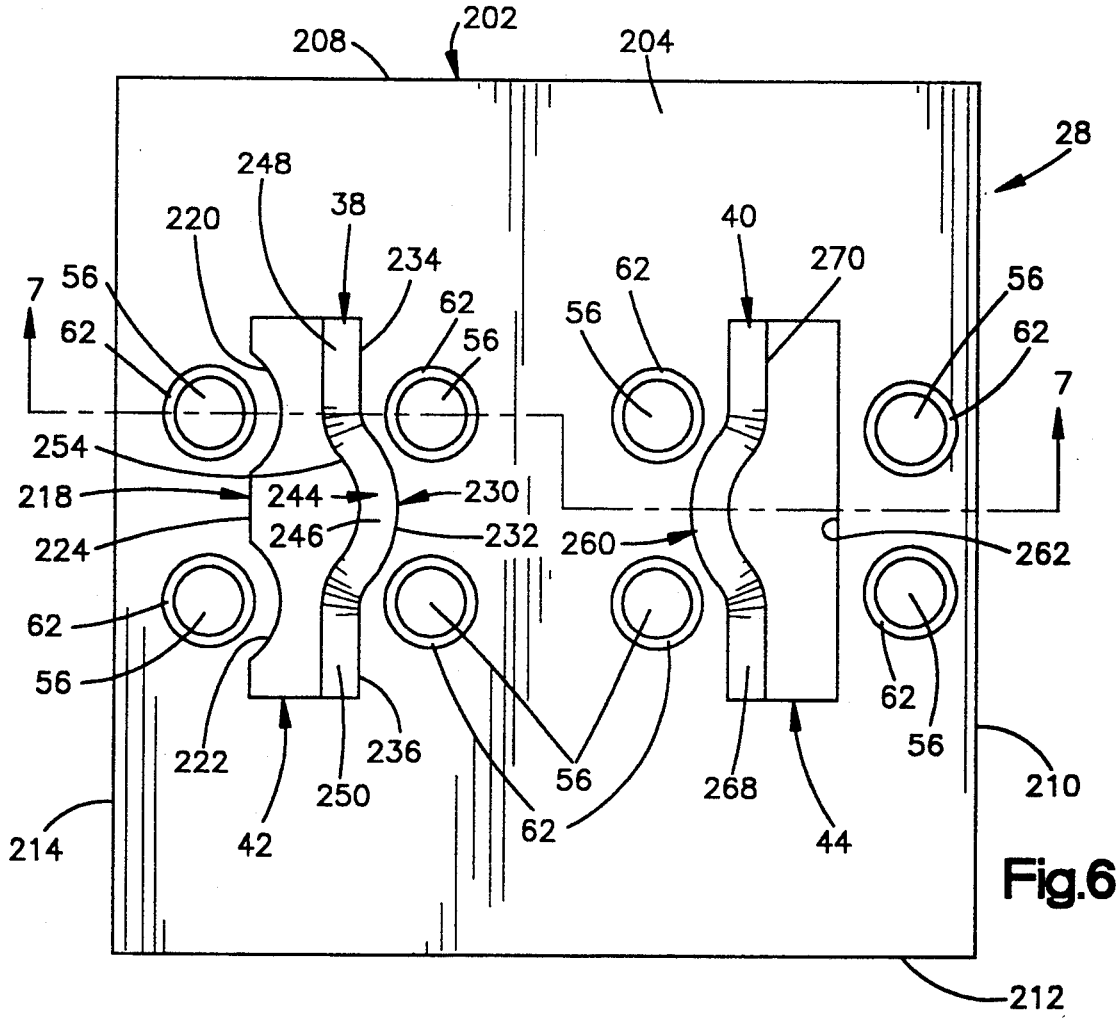
FIG. 6 is a plan view, on a somewhat larger scale than FIG. 4, of a lower connector section of the connector block assembly of FIG. 2.
Figure 7:
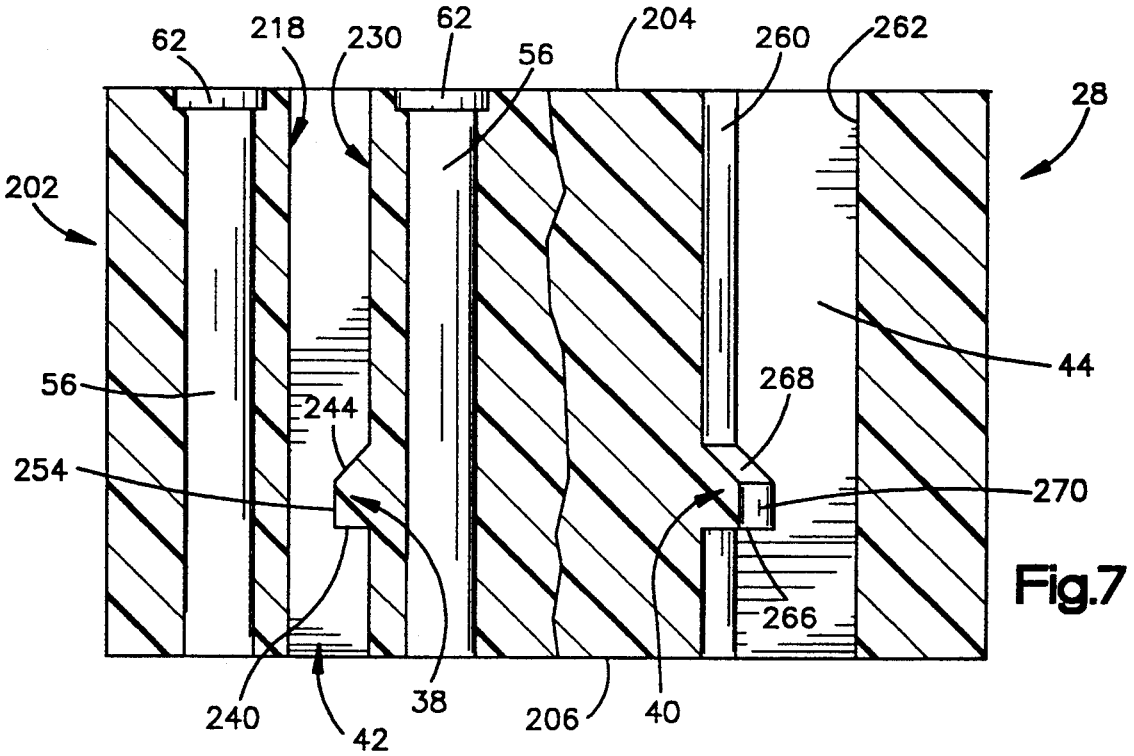
FIG. 7 is a sectional view, taken generally along the line 7—7 of FIG. 6.

The lower connector section 28 includes a generally rectangular body 202 (FIGS. 6 and 7). The rectangular body 202 has parallel upper and lower end surfaces 204 and 206 (FIG. 7). Four side surfaces 208, 210, 212 and 214 (FIG. 6) interconnect the end surfaces 204 and 206. It should be understood that FIG. 6 is on a somewhat larger scale than FIG. 4 and that the end surfaces 204 and 206 on the lower connector section 28 (FIG. 7) are the same size as the end surfaces 68 and 70 (FIGS. 3 and 4) on the upper connector section 26.

A plurality of generally cylindrical contact cavities 56 are formed in the rectangular body 202. The contact cavities 56 extend between the opposite end surfaces 204 and 206 (FIG. 7) of the rectangular body 202. The contact cavities 56 have longitudinal central axes which extend parallel to the central axis of the rectangular body 202 and perpendicular to the end surfaces 204 and 206.

Although only eight contact cavities 56 have been shown in the lower connector section 28, it should be understood that any desired number of contact cavities 56 could be provided in the lower connector section. The location and arrangement of the contact cavities 56 in the lower connector section 28 is such that the contact cavities 50 in the upper connector section 26 (FIG. 4) will be disposed in alignment with the contact cavities 56 (FIG. 6) in the lower connector section 28 when the upper and lower connector sections are interconnected (FIG. 2).

The retainer cavities 42 and 44 (FIG. 6) receive the retainer fingers 32 and 34. Therefore, the retainer cavity 42 has a cross sectional configuration which corresponds to the cross sectional configuration of the retainer finger 32. Similarly, the retainer cavity 44 has a cross sectional configuration which corresponds to the cross sectional configuration of the retainer finger 34.

The retainer cavity 42 has a rear side surface 218 (FIG. 6) with the same configuration as the rear side surface 94 (FIG. 4) of the left retainer finger 32. The rear side surface 218 has a pair of longitudinally extending ribs 220 and 222 which extend between opposite end surfaces 204 and 206 of the lower connector section 28. The ribs 220 and 222 in the rear side surface 218 of the retainer cavity 42 are received in the longitudinally extending grooves 124 and 126 (FIG. 4) formed in the rear side surface 94 of the retainer finger 32. A longitudinally extending flat side surface area 224 is disposed between the ribs 220 and 222.

The retainer cavity 42 has a longitudinally extending front side surface 230 and has the same configuration as the front side surface 92 on the retainer finger 32. Thus, the front side surface 230 of the retainer cavity 42 has a continuously curving central portion 232. A pair of flat side portions 234 and 236 are disposed on opposite sides of the central portion 232.

The rear and front side surfaces 218 and 230 extend axially through the rectangular body 202 between opposite end surfaces 204 and 206. The rear side surface 218 and front side surface 230 extend perpendicular to the end surfaces 204 and 206 of the rectangular body 202 (FIG. 7).

The latch flange 38 (FIG. 7) is formed in the front side surface 230 of the retainer cavity 42. The latch flange 38 is disposed closer to the lower end surface 206 of the rectangular body 202 than to the upper end surface 204. The latch flange 38 has a configuration which corresponds to the configuration of the head end portion 88 of the retainer finger 32 (FIGS. 4 and 6).

The latch flange 38 includes a latch surface 240. The latch surface 240 is disposed in a flat plane which extends parallel to the end surfaces 204 and 206 of the rectangular body 202. The latch surface 240 (FIG. 7) has the same configuration as the latch surface 120 (FIG. 5) formed on the head end section 88 of the left retainer finger 32.

The latch surface 240 (FIG. 7) extends rearward from the front side surface 230 of the retainer cavity 42 toward the rear side surface 218 for a distance which is the same as the extent to which the latch surface 120 on the head end portion 88 of the retainer finger 32 extends outward from the front side surface 92 of the body section 86 of the retainer finger 32 (FIG. 5). The latch surface 240 (FIG. 7) on the latch flange 238 has a continuously curving central portion corresponding to the continuously curving central portion 144 of the latch surface 120 on the retainer finger 32. The continuously curving central portion of the latch surface 240 projects toward the plane containing longitudinal central axes of an adjacent pair of contact cavities 56. Similarly, the latch surface 240 on the latch flange 38 has linear end portions with the same configuration as the linear end portions 148 and 150 of the latch surface 120 on the retainer finger 32.

In addition to the latch surface 240, the latch flange 238 has an upwardly facing cam surface 244 (FIGS. 6 and 7) with the same configuration as the cam surface 154 on the retainer finger 32 (FIGS. 3 and 4). Thus, the cam surface 244 (FIG. 6) has a continuously curving central portion 246. Linear side portions 248 and 250 are disposed on opposite sides of the continuously curving central portion 246. Although only the configuration of the cam surface 244 is illustrated in FIG. 6, it should be understood that the latch surface 240 has the same configuration as the cam surface 246.

A nose surface 254 (FIG. 7) extends between the cam surface 244 and latch surface 240. The nose surface 254 extends parallel to a longitudinal central axis of the retainer cavity 42 and perpendicular to the latch surface 240. The cam surface 244 is skewed at an acute angle, approximately 45°, to the nose surface 254. The nose surface 254 has an arcuately curving central portion and linear opposite edge portions.

When the retainer finger 32 is disposed in the retainer cavity 42, the nose surface 254 on the latch flange 38 (FIGS. 6 and 7) is disposed in abutting engagement with the front side surface 92 (FIG. 5) of the retainer finger. In addition, the nose surface 164 on the retainer finger 32 (FIG. 3) is disposed in abutting engagement with the front side surface 230 (FIGS. 6 and 7) of the retainer cavity 42 immediately beneath the latch surface 240. At this time, the latch surface 120 on the retainer finger 32 is disposed in flat abutting engagement with the latch surface 240 on the latch flange 38 throughout the extent of the latch surfaces 120 and 240.

The retainer cavity 44 has the same general construction and configuration as the retainer cavity 42. However, the retainer cavity 44 faces in the opposite direction from the retainer cavity 42. Thus, the retainer cavity 44 faces toward the retainer cavity 42 in much the same manner as in which the retainer finger 34 faces toward the retainer finger 32.

The retainer cavity 44 has a front side surface 260 and a rear side surface 262 (FIGS. 6 and 7) which extend between and are perpendicular to the two end surfaces 204 and 206. The front side surface 260 of the retainer cavity 44 has the same configuration as the front side surface 174 of the right retainer finger 34 (FIG. 3). Similarly, the rear side surface 262 (FIGS. 6 and 7) of the retainer cavity 44 has the same configuration as the rear side surface 177 (FIG. 3) of the right retainer finger 34. The rear side surface 262 of the retainer cavity 44 is flat and does not have ribs corresponding to the ribs 220 and 222 in the rear side surface 218 of the retainer cavity 42.

The latch flange 40 is disposed in the retainer cavity 44. The latch flange 40 includes a flat latch surface 266 (FIG. 7) which is disposed in the same plane as the latch surface 240 on the latch flange 38. The latch surface 266 has the same configuration as the latch surface 184 on the right retainer finger 34 (FIG. 3). A cam surface 268 on the latch flange 40 (FIGS. 6 and 7) has the same configuration as a cam surface on the right retainer finger 4. The latch surface 266 (FIG. 7) has the same configuration as the cam surface 268 (FIG. 6). The cam surface 268 and latch surface 266 on the latch flange 40 are interconnected by a nose surface 270 (FIG. 7).

When the retainer finger 34 is inserted into the retainer cavity 44, the nose surface 270 on the latch flange 40 is disposed in abutting engagement with the front side surface 174 on the retainer finger 34. At this time, the latch surface 184 on the retainer finger 34 is disposed in flat abutting engagement with the latch surface 266 on the latch flange 40 throughout the extent of the latch surfaces 184 and 266 (FIGS. 3 and 7).

Interconnecting

When the upper and lower connector sections 26 and 28 are to be interconnected, the retainer fingers 32 and 34 (FIGS. 3 and 4) on the upper connector section 26 are aligned with the retainer cavities 42 and 44 (FIGS. 6 and 7) in the lower connector section 28. At this time, the longitudinally extending recesses 124 and 126 on the retainer finger 32 are aligned with the longitudinally extending ribs 220 and 222 on the lower connector section 28. The cooperation between the ribs 220 and 222 and the retainer finger recesses 124 and 126 prevents the retainer finger 32 from being inserted into the retainer cavity 44 and the retainer finger 34 from being inserted into the retainer cavity 44. This prevents the upper and lower connector sections 26 and 28 from being interconnected in an incorrect orientation relative to each to other.

Once the retainer fingers 32 and 34 have been aligned with the retainer cavities 42 and 44, the retainer fingers are freely movable into the cavities until the head end sections 88 and 180 simultaneously engage the latch flanges 38 and 40 in the retainer cavities 42 and 44. When this occurs, the cam surfaces on the head end sections 88 and 180 of the retainer fingers 32 and 34 are in abutting engagement with the cam surfaces 244 and 268 on the latch flanges 38 and 40. Thus, the cam surface 154 on the latch finger 132 is disposed in abutting engagement with the cam surface 244 on the latch flange 38 throughout the extent of the cam surfaces. Similarly, the cam surface on the head end surface 180 of the retainer finger 34 is disposed in abutting engagement with the cam surface 268 on the latch flange 40 throughout the extent of the cam surfaces.

The upper connector section 26 is then pressed downwardly relative to the lower connector section 28. The interaction between the cam surfaces on the retainer fingers 32 and 34 and the latch flanges 38 and 40 resiliently deflects the retainer fingers sidewardly. Thus, the cam surface 154 on the latch finger 32 slides along the cam surface 244 on the latch flange 38 and deflects the retainer finger 32 toward the left (as viewed in FIG. 8).

The interaction between the cam surfaces on the retainer finger 34 and latch flange 40 deflects the retainer finger 34 in the opposite direction, that is, toward the right as viewed in FIG. 3.

Continued insertion of the retainer fingers 32 and 34 into the retainer cavities 42 and 44 moves the nose surfaces on the retainer fingers into sliding engagement with the nose surfaces on the latch flanges 38 and 40. Thus, the nose surface 164 on the retainer finger 32 will move into abutting engagement with the nose surface 254 on the latch flange 38, in the manner illustrated in FIG. 8. At this time, the rear side surface 94 on the retainer finger 32 is disposed in engagement with the rear side surface 218 of the retainer cavity 42 at the head end section 88 of the retainer finger 32. The retainer finger 34 will be in a similar position relative to the latch flange 40.

Continued insertion of the retainer fingers 32 and 34 into the retainer cavities 42 and 44 moves the latch surfaces 120 and 184 on the retainer fingers 32 and 34 into alignment with the latch surfaces 240 and 266 on the latch flanges 38 and 40. The next increment of downward movement of the upper connector section 26 relative to the lower connector section 28 allows the resiliently deflected latch fingers 32 and 34 to snap back to their normal or relaxed positions. As this occurs, the latch surfaces 120 and 184 on the retainer fingers 32 and 34 slide along and move into abutting engagement with the latch surfaces 240 and 266 on the latch flanges 38 and 40.

Once the latch surfaces 120 and 184 on the retainer fingers 32 and 34 have moved into engagement with the latch surfaces 240 and 266 on the latch flanges 38 and 40, the upper connector section 26 and lower connector section 28 are firmly and securely interconnected. It should be noted that the latch flanges 38 and 40 are spaced a sufficient distance from the lower end surface 206 of the lower connector section 28 so that the head end sections 88 and 180 of the retainer fingers 32 and 34 are disposed entirely within the retainer cavities 42 and 44. Thus, the end surface 168 on the retainer finger 32 will be disposed above (as viewed in FIG. 8) the end surface 206 on the lower connector section 28.

When the retainer fingers 32 and 34 are initially inserted into the retainer cavities 42 and 44, the contact cavities 50 and 56 in the upper and lower connector sections 26 and 28 are disposed in axial alignment with each other. At this time, the alignment collars 60 on the upper connector section 26 are spaced from the alignment recesses 62 in the lower connector section 28 (FIG. 8). As the retainer fingers 32 and 34 are fully inserted into the retainer cavities 42 and 44, the alignment collars 60 move into the alignment recesses 62. Engagement of the alignment collars 60 with the alignment recesses 62 accurately and positively aligns the contact cavities 50 and 56.

As the retainer fingers 32 and 34 are inserted into the retainer cavities 42 and 44, electrical contacts 48 and 54, which have been indicated schematically in FIG. 2, move into engagement with each other. The electrical contacts 48 and 54 have been omitted from FIGS. 3 through 8 in order to more clearly illustrate the construction of the upper and lower connector sections 26 and 28. However, it should be understood that an electrical contact 48 is disposed in each contact cavity 50 in the upper connector section 26. Similarly, an electrical contact 54 is disposed in each contact cavity 56 in the lower connector section 28. The alignment collars 60 and the alignment recesses 62 cooperate with each other to insure that excessive stresses are not applied by the electrical contacts to the connector sections 26 and 28 as they are interconnected.

One Specific Embodiment

The upper and lower connector sections 26 and 28 have been simplified in FIGS. 2 through 8 in order to more clearly depict the relationship between the retainer fingers 32 and 34 and the latch flanges 38 and 40. One specific embodiment of the upper and lower connector sections is illustrated in FIGS. 9 through 15. Since the specific embodiment of the invention illustrated in FIGS. 9 through 15 is generally the same as the embodiment of the invention illustrated in FIGS. 1 through 8, similar numerals will be utilized to identify similar components, the suffix letter "a" being associated with the embodiment of FIGS. 9 through 15 to avoid confusion.

Figure 10:
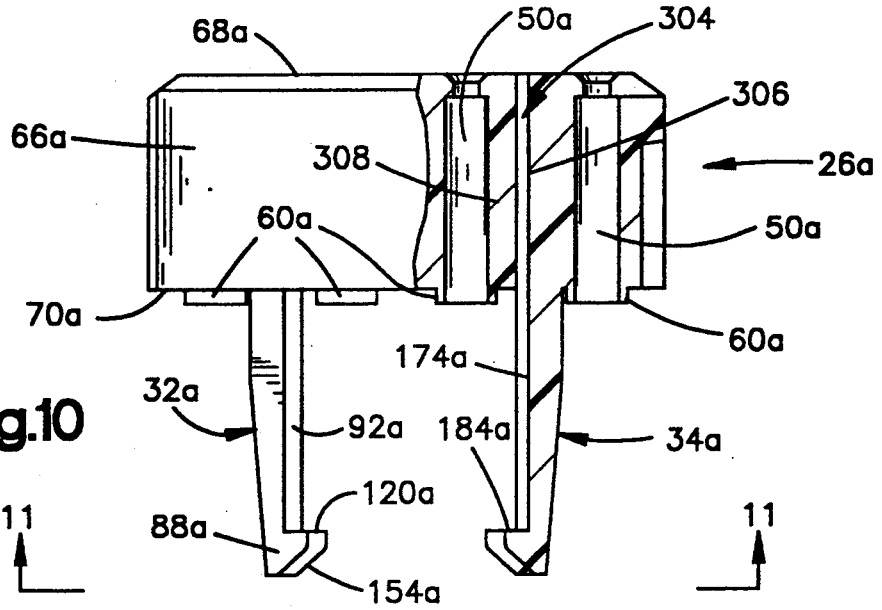
FIG. 10 is a side elevational view, taken generally along the line 10—10 of FIG. 9, illustrating the construction of contact cavities and retainer fingers of the upper connector section.
Figure 11:
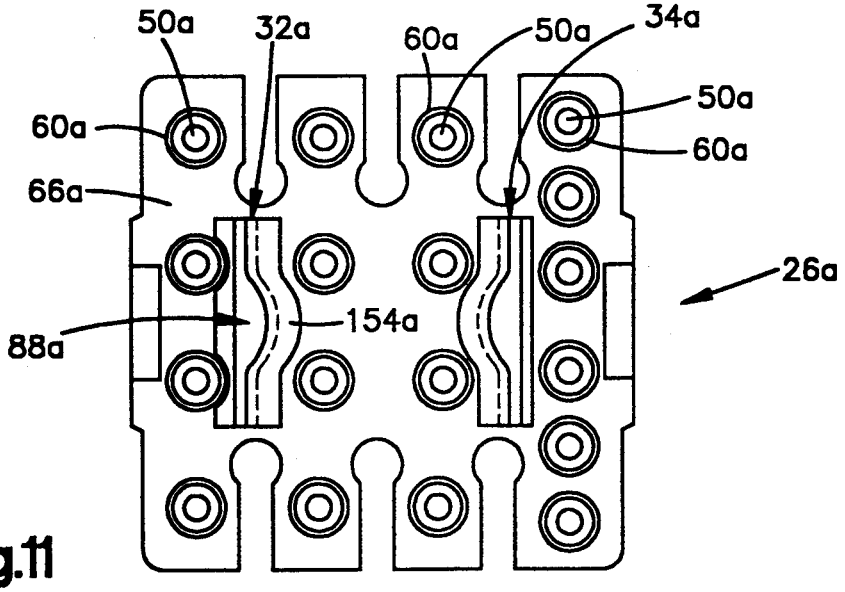
FIG. 11 is a bottom plan view, taken generally along the line 11—11 of FIG. 10 further illustrating the construction of the upper connector section.
Figure 12:
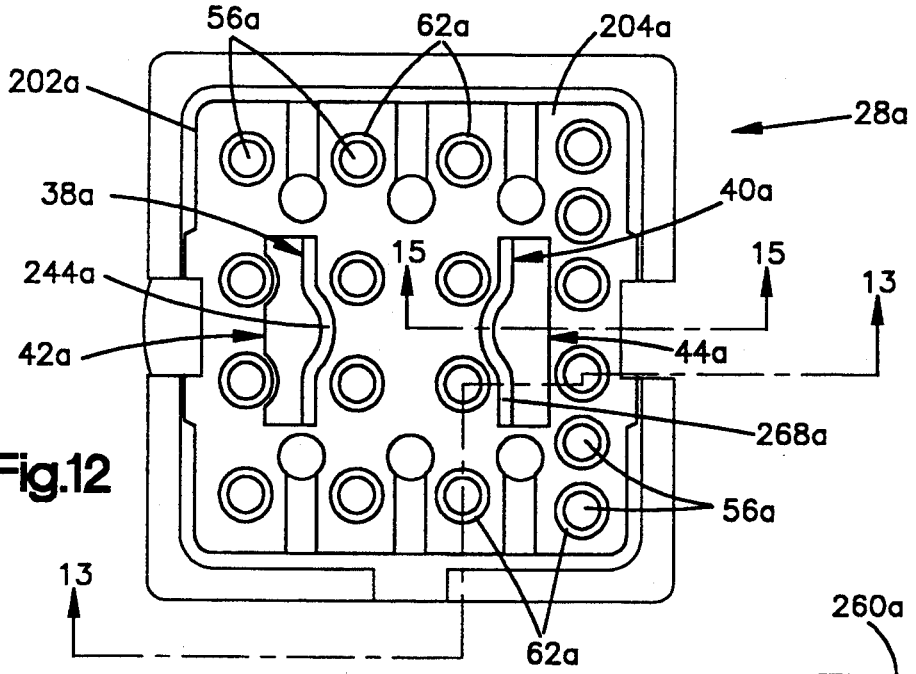
FIG. 12 is a top plan view of a lower connector section which is intended for use with the upper connector section of FIGS. 9–11.
Figure 13:
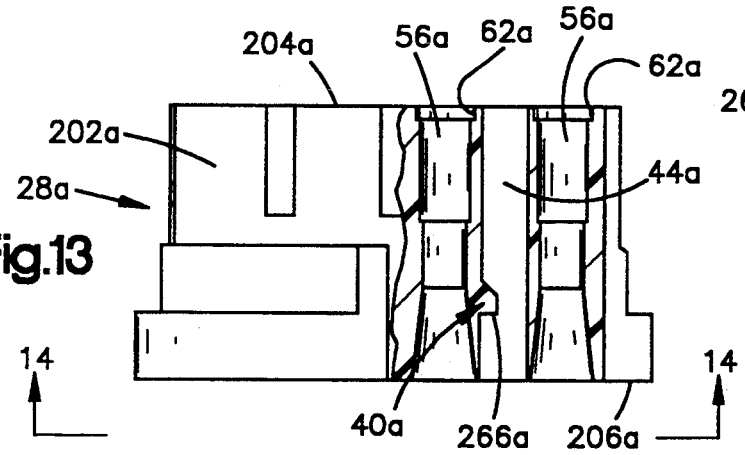
FIG. 13 is a partially broken away side elevational view, taken generally along the line 13—13 of FIG. 12, further illustrating the construction of the lower connector section.
Figure 15:
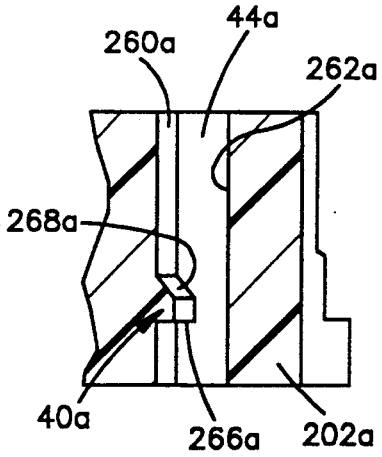
FIG. 15 is a fragmentary sectional view, taken generally along the line 15—15 of FIG. 12, illustrating the construction of a retainer cavity in the lower connector section.
Figure 14:
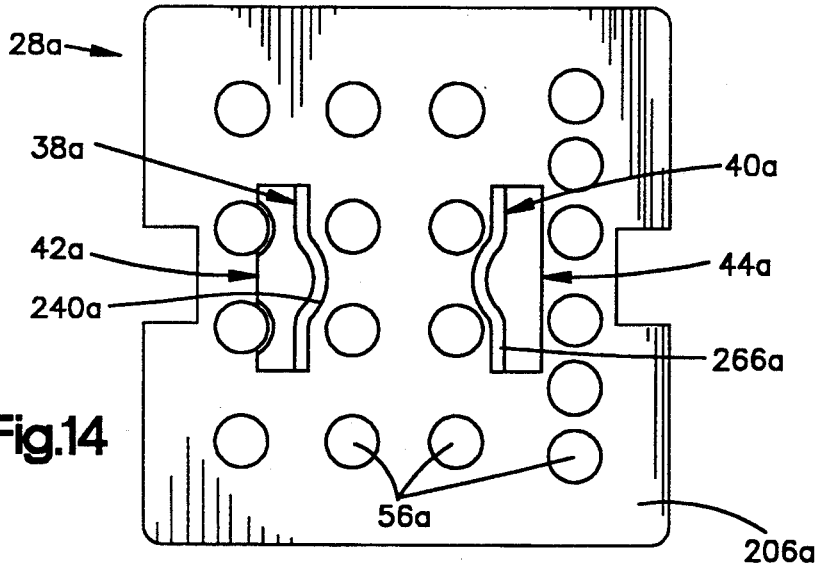
FIG. 14 is a bottom plan view, taken generally along the line 14—14 of FIG. 13, further illustrating the construction of the lower connector section.

The upper connector section **26*a* (FIGS. 9–11) is molded as one piece of polymeric material. The upper connector section 26*a* includes a rectangular body 66*a* having upper and lower side surfaces 68*a* and 70*a* (FIG. 10). Alignment collars 60*a* (FIGS. 10 and 11) project from the lower side surface 70*a* of the rectangular body 66*a*. The annular alignment collars 60*a* are disposed in a coaxial relationship with generally cylindrical contact cavities 50*a***.

Retainer fingers **32*a* and 34*a* extend downwardly (as viewed in FIG. 10) from the body 66*a*. The retainer fingers 32*a* and 34*a* have latch surfaces 120*a* and 184*a* which are disposed in a plane which extends parallel to a lower side surface 70*a* of the body 66*a***.

In accordance with a feature of this embodiment of the invention, slots 302 and 304 (FIG. 9) extend through the rectangular body **66*a*. The slot 302 is associated with the retainer finger 32*a* and the slot 304 is associated with the retainer finger 34*a***.

The slot 304 has a side surface 306 (FIGS. 9 and 10) which is formed as a continuation of the front side surface **174*a* (FIG. 10) of the retainer finger 34*a*. The side surface 308 of the slot 304 is offset from the side surface 306 and has the same configuration as the side surface 306. Therefore, the slot 304** has a uniform cross sectional configuration throughout its length.

Although only the slot 304 is illustrated in FIG. 10, it should be understood that the slot 302 (FIG. 9) has a side surface 312 which is formed as a continuation of the front side surface **92*a* of the retainer finger 32*a*. In addition, the slot 302 has a side surface 314 with the same configuration as the side surface 312**.

During forming of the upper connector section **26*a*, a slide having a mold surface with the same configuration as the front surfaces 92*a* and 174*a* on the retainer fingers 32*a* and 34*a* is used to form the slots 302 and 304. The ends of the slides are used to form the latch surfaces 120*a* and 184*a*. Although slots, corresponding to the slots 302 and 304 have not been shown in conjunction with the embodiment of the invention illustrated in FIGS. 3 and 4**, it should be understood that similar slots could be provided if desired.

The lower connector section **28*a* (FIGS. 12–15) includes a rectangular body 202*a* in which contact cavities 56*a* and retainer cavities 42*a* and 44*a* are formed. Cylindrical alignment recesses 62*a* (FIG. 13) are formed in the upper end portions of the contact cavities 56*a*. Latch flanges 38*a* and 40*a* (FIGS. 12 and 14) are provided in the retainer cavities 42*a* and 44*a*. The latch flanges 38a and 40a have downwardly facing latch surfaces 240a and 266a (FIG. 14) which are disposed in a flat plane extending parallel to a lower side surface 206a of the lower connector section 28a**.

The upper and lower connector sections 26a and 28a are intended for use in a switch assembly. Specifically, the upper and lower connector sections 26a and 28a are intended for use in a Series 584 switch assembly which is commercially available from Eaton Corporation, Aerospace Controls Division, Costa Mesa, Calif. In this specific instance, it is contemplated that electrical contacts constructed in accordance with U.S. Military Specification Mil-C-39029/57-354 will be utilized in the contact cavities 50a and 56a. It should be understood that a connector block assembly constructed in accordance with the present invention may be used in many different environments and it is not intended to limit the invention to any specific environment or connector block assembly design. It should also be understood that many different types of electrical contacts may be used with a connector block assembly constructed in accordance with the present invention and it is not intended to limit the electrical contacts to any specific design of electrical contacts.

Conclusion

In view of the foregoing description, it is apparent that the present invention relates to a new and improved connector block assembly 12 for use in interconnecting electrical conductors 20 and 22 (FIG. 2). The connector block assembly 12 includes a pair of connector sections 26 and 28 in which contact cavities 50 and 56 are formed. A resiliently deflectable retainer finger 32 extends outward from the connector section 26 and is received in a retainer cavity 42 in the other connector section 28.

The resiliently deflectable retainer finger 32 has a body section 86 and a head end section 88. The head end section of the retainer finger 32 has a latch surface 120. The latch surface 120 on the retainer finger 32 engages a latch surface 240 on a latch flange 38 formed in the retainer cavity 42 to interconnect the two sections 26 and 28 of the connector block assembly 12.

The body section 86 of the retainer finger 32 has a longitudinally extending central portion 104 which is thicker than longitudinally extending side portions 114 and 116 of the retainer finger. The relatively thick central portion 104 of the retainer finger 32 enhances the strength of the retainer finger and enables it to be fitted into an array of contact cavities (FIGS. 4 and 6).

In order to promote accurate alignment of the contact cavities 50 and 56, alignment collars 60 project outward from the connector section 26. The alignment collars 60 are received in alignment recesses 62 in the other connector section 28. The alignment collars 60 and recesses 62 accurately position the contact cavities 50 and 56 in the two connector sections 26 and 28 relative to each other.

Having described the invention, the following is claimed:

1. A connector block assembly for use in connecting a first plurality of electrical conductors with a second plurality of electrical conductors, said connector block assembly comprising a first connector section which is formed as one piece and receives a first plurality of contacts which are associated with the first plurality of electrical conductors, and a second connector section which is formed as one piece and receives a second plurality of contacts which are associated with the second plurality of electrical conductors, said first connector section of said connector block assembly having first and second end surfaces which are interconnected by side surfaces, surface means for defining a first series of contact cavities which extend between said first and second end surfaces of said first connector section to receive the first plurality of contacts, and a resiliently deflectable retainer finger extending outward from said first end surface of said first connector section and having a longitudinal central axis extending generally parallel to central axes of contact cavities of said first series of contact cavities, said retainer finger having an elongated body section and a head end section, said head end section of said retainer finger having a cam surface which extends transversely to the longitudinal central axis of said retainer finger and a latch surface which extends transversely to said cam surface and to the longitudinal central axis of said latch finger, said body section of said retainer finger having a longitudinally extending central portion and longitudinally extending side portions disposed along opposite sides of said central portion, said longitudinally extending central portion of said retainer finger having a greater thickness as viewed in a plane extending perpendicular to the longitudinal central axis of said retainer finger than said longitudinally extending side portions of said retainer finger, said latch surface on said head end section of said retainer finger projecting outward in a first direction from the longitudinal central axis of said retainer finger, said body section of said retainer finger having a first longitudinally extending side surface which faces in the first direction, said first longitudinally extending side surface of said body section of said retainer finger having a central portion with a continuously curving configuration as viewed in a plane extending perpendicular to the longitudinal central axis of said body section, said second connector section of said connector block assembly having first and second end surfaces which are interconnected by side surfaces, surface means defining a second series of contact cavities which extend between said first and second end surfaces of said second connector section to receive the second plurality of contacts, and surface means for defining a retainer cavity which extends inward from said first end surface of said second connector section of said connector block assembly and has a longitudinal central axis extending generally parallel to central axes of contact cavities of said second series of contact cavities, at least a portion of said retainer cavity having a longitudinally extending central portion and longitudinally extending side portions disposed along opposite sides of said central portion of said retainer cavity, said longitudinally extending central portion of said retainer cavity having a greater thickness as viewed in a plane extending perpendicular to the longitudinal central axis of said retainer cavity than said longitudinally extending side portions of said retainer cavity, said surface means for defining a retainer cavity including means for defining a latch flange which is disposed within said second connector section of said connector block assembly at a location between and spaced from said first and second end surfaces of said second connector section of said connector block assembly, said latch flange having a cam surface which extends transversely to the longitudinal central axis of said retainer cavity and a latch surface which extends transversely to said cam surface and to the longitudinal central axis of said retainer cavity, said cam surface on said head end section of said retainer finger being engageable with said cam surface on said latch flange to resiliently deflect said retainer finger during insertion of said retainer finger into said retainer cavity, said latch surface on said head end section of said retainer finger being disposed in abutting engagement with said latch surface on said latch flange when said retainer finger is inserted into said retainer cavity to block withdrawal of said retainer finger from said retainer cavity, said first series of contact cavities in said first connector section of said connector block assembly being aligned with said second series of contact cavities in said second connector section of said connector block assembly when said retainer finger is inserted in said retainer cavity, said retainer cavity having a side surface which extends parallel to a longitudinal central axis of said retainer cavity and faces toward the longitudinal central axis of said retainer cavity, said side surface of said retainer cavity having a central portion with a continuously curving configuration as viewed in a plane extending perpendicular to the longitudinal central axis of said retainer cavity, the continuously curving configuration of the central portion of said side surface of said retainer cavity corresponds to the continuously curving configuration of said first longitudinally extending side surface of said body section of said retainer finger, said side surface of said retainer cavity having first and second side portions disposed along opposite sides of said central portion of said side surface of said retainer cavity, said first and second side portions having linear configurations as viewed in a plane extending perpendicular to the longitudinal central axis of said retainer cavity, said latch surface on said latch flange extending outward from said central portion and said first and second side portions of said side surface of said retainer cavity toward the longitudinal central axis of said retainer cavity for the same distance throughout the extent of said latch surface on said latch flange.

2. A connector block assembly as set forth in claim 1 wherein said latch surface on said head end section of said retainer finger has a central portion with a continuously curving configuration as viewed in a plane extending perpendicular to the longitudinal central axis of said body section, said continuously curving central portion of said latch surface on said head end section of said retainer finger having a configuration which corresponds to the configuration of the continuously curving central portion of said first longitudinally extending side surface of said body section.

3. A connector block assembly as set forth in claim 2 wherein first longitudinally extending side surface of said body section extends from said latch surface on said head end section of said retainer finger to said first end surface on said first connector section of said connector block assembly.

4. A connector block assembly as set forth in claim 1 wherein said first longitudinally extending side surface of said body section of said retainer finger has first and second side portions disposed along opposite sides of said central portion of said first longitudinally extending side surface of said body section of said retainer finger, said first and second side portions having linear configurations as viewed in a plane extending perpendicular to the longitudinal central axis of said body section.

5. A connector block assembly as set forth in claim 4 wherein said first and second side portions of said first longitudinally extending side surface of said body section of said retainer finger are disposed in a single flat plane, said central portion of said first longitudinally extending side surface of said body section extending in the first direction from the single flat plane.

6. A connector block assembly as set forth in claim 5 wherein said latch surface on said head end section of said retainer finger extends outward from said central portion and first and second side portions of said first longitudinally extending side surface of said body section in the first direction for the same distance throughout the extent of said latch surface on said head end section of said retainer finger and throughout the extent of said side surface of said body section.

7. A connector assembly as set forth in claim 1 wherein said latch surface on said latch flange has a central portion with a continuously curving configuration as viewed in a plane extending perpendicular to the longitudinal central axis of said retainer cavity, said continuously curving central portion of said latch surface on said latch flange having a configuration which corresponds to the configuration of said central portion of said side surface of said retainer cavity.

8. A connector assembly as set forth in claim 7 wherein said side surface of said retainer cavity extends from said latch surface on said latch flange to said second end surface of said second connector section of said connector block assembly.

9. A connector assembly as set forth in claim 8 wherein the distance from said latch surface on said latch flange to said second end surface of said second connector section of said connector block assembly is less than the distance from said latch surface on said latch flange to said first end surface of said second connector section of said connector block assembly.

10. A connector assembly as set forth in claim 1 wherein one of said first and second connector sections of said connector block assembly includes a plurality of alignment collars which are axially aligned with contact cavities in said one of said first and second connector sections and which project outward of said first end surface of said one of said first and second connector sections, another one of said first and second connector sections including a plurality of recesses which are axially aligned with contact cavities in said another one of said first and second connector sections and which extend inward of said first end surface of said another one of said first and second connector sections, said recesses in said another one of said first and second connector sections having configurations corresponding to the configuration of said alignment collars, said alignment collars being disposed in said recesses when said retainer finger is inserted in said retainer cavity.

11. A connector assembly as set forth in claim 1 wherein said body section of said retainer finger has a longitudinally extending side surface which extends from said latch surface on said head end section of said retainer finger to said first end surface on said first connector section of said connector block assembly, said first connector section of said connector block assembly including surface means for defining a slot which extends between said first and second end surfaces of said first connector section of said connector block assembly, said slot having a side surface which is aligned with and formed as a continuation of the longitudinally extending side surface on said retainer finger.

12. A connector block assembly as set forth in claim 11 wherein said slot is at least partially aligned with said retainer cavity and said latch flange in said retainer cavity when said retainer finger is inserted in said retainer cavity.

13. A connector block assembly as set forth in claim 1 wherein said first connector section of said connector block assembly further includes a second resiliently deflectable retainer finger extending outward from said first end surface of said first connector section and having a longitudinal central axis extending generally parallel to central axes of contact cavities of said first series of contact cavities, said second retainer finger having an elongated body section and a head end section, said head end section of said second retainer finger having a cam surface which extends transversely to the longitudinal central axis of said second retainer finger and a latch surface which extends transversely to the longitudinal central axis of said second retainer finger, said body section of said second retainer finger having a longitudinally extending central portion and longitudinally extending side portions disposed along opposite sides of said central portion, said longitudinally extending central portion of said second retainer finger having a greater thickness as viewed in a plane extending perpendicular to the longitudinal central axis of said second retainer finger than said longitudinally extending side portions of said second retainer finger, said second connector section of said connector assembly further including surface means for defining a second retainer cavity which extends inward from said first end surface of said second connector section of said connector block assembly and has a longitudinal central axis extending generally parallel to central axes of contact cavities of said second series of contact cavities, at least a portion of said second retainer cavity having a longitudinally extending central portion and longitudinally extending side portions disposed along opposite sides of said central portion of said second retainer cavity, said longitudinally extending central portion of said second retainer cavity having a greater thickness as viewed in a plane extending perpendicular to the longitudinal central axis of said second retainer cavity than said longitudinally extending side portions of said second retainer cavity, said surface means for defining a second retainer cavity including means for defining a second latch flange which is disposed within said second connector section of said connector block assembly at a location between and spaced from said first and second end surfaces of said second connector section of said connector block assembly.

14. A connector block assembly for use in connecting a first plurality of electrical conductors with a second plurality of electrical conductors, said connector block assembly comprising a first connector section which is formed as one piece and receives a first plurality of contacts which are associated with the first plurality of electrical conductors, and a second connector section which is formed as one piece and receives a second plurality of contacts which are associated with the second plurality of electrical conductors, said first connector section of said connector block assembly having first and second end surfaces which are interconnected by side surfaces, surface means for defining a first series of contact cavities which extend between said first and second end surfaces of said first connector section to receive the first plurality of contacts, and a resiliently deflectable retainer finger extending outward from said first end surface of said first connector section and having a longitudinal central axis extending generally parallel to central axes of contact cavities of said first series of contact cavities, said retainer finger having an elongated body section and a head end section, said head end section of said retainer finger having a cam surface which extends transversely to the longitudinal central axis of said retainer finger and a latch surface which extends transversely to said cam surface and to the longitudinal central axis of said latch finger, said body section of said retainer finger having a longitudinally extending central portion and longitudinally extending side portions disposed along opposite sides of said central portion, said longitudinally extending central portion of said retainer finger having a greater thickness as viewed in a plane extending perpendicular to the longitudinal central axis of said retainer finger than said longitudinally extending side portions of said retainer finger, said body section of said retainer finger including a first longitudinally extending side surface having a plurality of longitudinally extending recesses formed therein, each of said longitudinally extending recesses having an arcuate configuration as viewed in a plane extending perpendicular to the longitudinal central axis of said body section with a center of curvature disposed on a longitudinal central axis of one of said contact cavities of said first series of contact cavities, said second connector section of said connector block assembly having first and second end surfaces which are interconnected by side surfaces, surface means defining a second series of contact cavities which extend between said first and second end surfaces of said second connector section to receive the second plurality of contacts, and surface means for defining a retainer cavity which extends inward from said first end surface of said second connector section of said connector block assembly and has a longitudinal central axis extending generally parallel to central axes of contact cavities of said second series of contact cavities, at least a portion of said retainer cavity having a longitudinally extending central portion and longitudinally extending side portions disposed along opposite sides of said central portion of said retainer cavity, said longitudinally extending central portion of said retainer cavity having a greater thickness as viewed in a plane extending perpendicular to the longitudinal central axis of said retainer cavity than said longitudinally extending side portions of said retainer cavity, said surface means for defining a retainer cavity including means for defining a latch flange which is disposed within said second connector section of said connector block assembly at a location between and spaced from said first and second end surfaces of said second connector section of said connector block assembly, said latch flange having a cam surface which extends transversely to the longitudinal central axis of said retainer cavity and a latch surface which extends transversely to said cam surface and to the longitudinal central axis of said retainer cavity, said cam surface on said head end section of said retainer finger being engageable with said cam surface on said latch flange to resiliently deflect said retainer finger during insertion of said retainer finger into said retainer cavity, said latch surface on said head end section of said retainer finger being disposed in abutting engagement with said latch surface on said latch flange when said retainer finger is inserted into said retainer cavity to block withdrawal of said retainer finger from said retainer cavity, said first series of contact cavities in said first connector section of said connector block assembly being aligned with said second series of contact cavities in said second connector section of said connector block assembly when said retainer finger is inserted in said retainer cavity.

15. A connector block assembly as set forth in claim 14 wherein said latch surface on said head end section of said retainer finger projects outward in a first direction from the longitudinal central axis of said retainer finger, said body section of said retainer finger having a second longitudinally extending side surface which faces in the first direction, said second longitudinally extending side surface of said body section of said retainer finger having a central portion with a continuously curving configuration as viewed in a plane extending perpendicular to the longitudinal central axis of said body section.

16. A connector block assembly as set forth in claim 14 wherein said latch surface on said head end section of said retainer finger has a central portion with a continuously curving configuration as viewed in a plane extending perpendicular to the longitudinal central axis of said body section, said continuously curving central portion of said latch surface on said head end section of said retainer finger having a configuration which corresponds to the configuration of the continuously curving central portion of said second longitudinally extending side surface of said body section.

17. A connector block assembly as set forth in claim 16 wherein second longitudinally extending side surface of said body section extends from said latch surface on said head end section of said retainer finger to said first end surface on said first section of said connector block assembly.

18. A connector block assembly as set forth in claim 16 wherein said second longitudinally extending side surface of said body section of said retainer finger has first and second side portions disposed along opposite sides of said central portion of said second longitudinally extending side surface of said body section of said retainer finger, said first and second side portions having linear configurations as viewed in a plane extending perpendicular to the longitudinal central axis of said body section.

19. A connector block assembly as set forth in claim 18 wherein said first and second side portions of said second longitudinally extending side surface of said body section of said retainer finger are disposed in a single flat plane, said central portion of said second longitudinally extending side surface of said body section extending in the first direction from the single flat plane.

20. A connector block assembly as set forth in claim 19 wherein said latch surface on said head end section of said retainer finger extends outward from said central portion and first and second side portions of said second longitudinally extending side surface of said body section in the first direction for the same distance throughout the extent of said latch surface on said head end section of said retainer finger and throughout the extent of said second longitudinally extending side surface of said body section.

21. A connector assembly as set forth in claim 15 wherein said retainer cavity has a side surface which extends parallel to a longitudinal central axis of said retainer cavity and faces toward the longitudinal central axis of said retainer cavity, said side surface of said retainer cavity having a central portion with a continuously curving configuration as viewed in a plane extending perpendicular to the longitudinal central axis of said retainer cavity, the continuously curving configuration of the central portion of said side surface of said retainer cavity corresponds to the continuously curving configuration of said second longitudinally extending side surface of said body section of said retainer finger.

22. A connector assembly as set forth in claim 21 wherein said latch surface on said latch flange has a central portion with a continuously curving configuration as viewed in a plane extending perpendicular to the longitudinal central axis of said retainer cavity, said continuously curving central portion of said latch surface on said latch flange having a configuration which corresponds to the configuration of said central portion of said side surface of said retainer cavity.

23. A connector assembly as set forth in claim 22 wherein said side surface of said retainer cavity extends from said latch surface on said latch flange to said second end surface of said second connector section of said connector block assembly.

24. A connector assembly as set forth in claim 23 wherein the distance from said latch surface on said latch flange to said second end surface of said second connector section of said connector assembly is less than the distance from said latch surface on said latch flange to said first end surface of said second section of said connector block assembly.

25. A connector assembly as set forth in claim 21 wherein said side surface of said retainer cavity has first and second side portions disposed along opposite sides of said central portion of said side surface of said retainer cavity, said first and second side portions having linear configurations as viewed in a plane extending perpendicular to the longitudinal central axis of said retainer cavity.

26. A connector assembly as set forth in claim 25 wherein said latch surface on said latch flange extends outward from said central portion and said first and second side portions of said side surface of said retainer cavity toward the longitudinal central axis of said retainer cavity for the same distance throughout the extent of said latch surface on said latch flange.

27. A connector assembly as set forth in claim 14 wherein one of said first and second connector sections of said connector block assembly includes a plurality of alignment collars which are axially aligned with contact cavities in said one of said first and second connector sections and which project outward of said first end surface of said one of said first and second connector sections, another one of said first and second connector sections including a plurality of recesses which are axially aligned with contact cavities in said another one of said first and second connector sections and which extend inward of said first end surface of said another one of said first and second connector sections, said recesses in said another one of said first and second connector sections having configurations corresponding to the configuration of said alignment collars, said alignment collars being disposed in said recesses when said retainer finger is inserted in said retainer cavity.

28. A connector assembly as set forth in claim 14 wherein said body section of said retainer finger has a second longitudinally extending side surface which extends from said latch surface on said head end section of said retainer finger to said first end surface on said first section of said connector block assembly, said first connector section of said connector block assembly including surface means for defining a slot which extends between said first and second end surfaces of said first connector section of said connector block assembly, said slot having a side surface which is aligned with and formed as a continuation of the longitudinally extending side surface on said retainer finger.

29. A connector block assembly as set forth in claim 28 wherein said slot is at least partially aligned with said retainer cavity and said latch flange in said retainer cavity when said retainer finger is inserted in said retainer cavity.

30. A connector block assembly as set forth in claim 14 wherein said first longitudinally extending side surface of said retainer finger includes a longitudinally extending flat side surface area disposed between a pair of said longitudinally extending recesses formed in said first longitudinally extending side surface, said flat side surface area being disposed in a plane located between and extending parallel to the longitudinal central axis of said body section and the longitudinal central axes of the contact cavities on which the centers of curvature of said longitudinally extending recesses are located.

31. A connector block assembly as set forth in claim 14 wherein said first connector section of said connector block assembly further includes a second resiliently deflectable retainer finger extending outward from said first end surface of said first connector section and having a longitudinal central axis extending generally parallel to central axes of contact cavities of said first series of contact cavities, said second retainer finger having an elongated body section and a head end section, said head end section of said second retainer finger having a cam surface which extends transversely to the longitudinal central axis of said second retainer finger and a latch surface which extends transversely to the longitudinal central axis of said second retainer finger, said body section of said second retainer finger having a longitudinally extending central portion and longitudinally extending side portions disposed along opposite sides of said central portion, said longitudinally extending central portion of said second retainer finger having a greater thickness as viewed in a plane extending perpendicular to the longitudinal central axis of said second retainer finger than said longitudinally extending side portions of said second retainer finger, said second connector section of said connector assembly further including surface means for defining a second retainer cavity which extends inward from said first end surface of said second connector section of said connector block assembly and has a longitudinal central axis extending generally parallel to central axes of contact cavities of said second series of contact cavities, at least a portion of said second retainer cavity having a longitudinally extending central portion and longitudinally extending side portions disposed along opposite sides of said central portion of said second retainer cavity, said longitudinally extending central portion of said second retainer cavity having a greater thickness as viewed in a plane extending perpendicular to the longitudinal central axis of said second retainer cavity than said longitudinally extending side portions of said second retainer cavity, said surface means for defining a second retainer cavity including means for defining a second latch flange which is disposed within said second connector section of said connector block assembly at a location between and spaced from said first and second end surfaces of said second connector section of said connector block assembly.

32. A connector block assembly for use in connecting a first plurality of electrical conductors with a second plurality of electrical conductors, said connector block assembly comprising a first connector section which is formed as one piece and receives a first plurality of contacts which are associated with the first plurality of electrical conductors, and a second connector section which is formed as one piece and receives a second plurality of contacts which are associated with the second plurality of electrical conductors, said first connector section of said connector block assembly having first and second end surfaces which are interconnected by side surfaces, surface means for defining a first series of contact cavities which extend between said first and second end surfaces of said first connector section to receive the first plurality of contacts, and first and second resiliently deflectable retainer fingers extending outward from said first end surface of said first connector section and having longitudinal central axes extending generally parallel to central axes of contact cavities of said first series of contact cavities, each one of said retainer fingers having an elongated body section and a head end section, said head end section of each one of said retainer fingers having a cam surface which extends transversely to the longitudinal central axis of said one retainer finger and a latch surface which extends transversely to said cam surface and to the longitudinal central axis of said one latch finger, said second connector section of said connector block assembly having first and second end surfaces which are interconnected by side surfaces, surface means defining a second series of contact cavities which extend between said first and second end surfaces of said second connector section to receive the second plurality of contacts, and surface means for defining first and second retainer cavities which extend inward from said first end surface of said second connector section of said connector block assembly and have longitudinal central axes extending generally parallel to central axes of contact cavities of said second series of contact cavities, said surface means for defining said first and second retainer cavities including means for defining a latch flange in each of said retainer cavities, each of said latch flanges being disposed within said second section of said connector block assembly at a location between and spaced from said first and second end surfaces of said second section of said connector block assembly, each one of said latch flanges having a cam surface which extends transversely to longitudinal central axes of said retainer cavities and a latch surface which extends transversely to said cam surfaces on said latch flanges and to the longitudinal central axes of said retainer cavities, said cam surfaces on said head end sections of said first and second retainer fingers being engageable with said cam surfaces on said latch flanges to resiliently deflect said first and second retainer fingers during insertion of said first and second retainer fingers into said first and second retainer cavities, said latch surfaces on said head end sections of said first and second retainer fingers being disposed in abutting engagement with said latch surfaces on said latch flanges when said first and second retainer fingers are inserted into said first and second retainer cavities to block withdrawal of said first and second retainer fingers from said first and second retainer cavities, said first connector section of said connector block assembly including a plurality of alignment collars which are axially aligned with contact cavities in said first connector section and which project outward of said first end surface of said first connector section, said second connector section including a plurality of recesses which are axially aligned with contact cavities in said second connector section and which extend inward of said first end surface of said second connector section, said recesses in said second connector section having configurations corresponding to the configuration of said alignment collars, said alignment collars being disposed in said recesses when said retainer fingers are inserted in said retainer cavity, said body section of said first retainer finger including a first longitudinally extending side surface having a plurality of longitudinally extending recesses formed therein, each of said recesses having an arcuate configuration as viewed in a plane extending perpendicular to the longitudinal central axis of said body section with a center of curvature disposed on a longitudinal central axis of one of said contact cavities of said first series of contact cavities and one of said alignment collars of said plurality of alignment collars.

33. A connector assembly as set forth in claim 32 wherein said body section of each one of said first and second retainer fingers includes a second longitudinally extending side surface which extends from said latch surface on said head end portion of said one of said first and second retainer fingers to said first end surface on said first connector section of said connector block assembly, said first connector section of said connector block assembly including surface means for defining a plurality of slots which extend between said first and second end surfaces of said first connector section of said connector block assembly, each of said slots having a side surface which is aligned with and formed as a continuation of the second longitudinally extending side surface on one of said first and second retainer fingers.

34. A connector assembly as set forth in claim 32 wherein said head end sections of said first and second retainer fingers are entirely disposed within said first and second retainer cavities when said first and second retainer fingers are inserted in said first and second retainer cavities.

35. A connector assembly as set forth in claim 32 wherein each of said latch surfaces on said head end sections of said first and second retainer fingers has a central portion with a curving configuration as viewed in a plane extending perpendicular to a longitudinal central axis of said first section of said connector assembly, each of said latch surfaces on said head end sections of said first and second retainer fingers having first and second side portions disposed at opposite sides of said central portion and having linear configurations as viewed in the plane extending perpendicular to a longitudinal central axis of said first connector section of said connector assembly.

36. A connector block assembly for use in connecting a first plurality of electrical conductors with a second plurality of electrical conductors, said connector block assembly comprising a first connector section which receives a first plurality of contacts which are associated with the first plurality of electrical conductors, and a second connector section which receives a second plurality of contacts which are associated with the second plurality of electrical conductors, said first connector section of said connector block assembly having first and second end surfaces which are interconnected by side surfaces, surface means for defining a first series of contact cavities which extend between said first and second end surfaces of said first connector section to receive the first plurality of contacts, and a resiliently deflectable retainer finger extending outward from said first end surface of said first connector section and having a longitudinal central axis extending generally parallel to central axes of contact cavities of said first series of contact cavities, said retainer finger having an elongated body section and a head end section, said head end section of said retainer finger having a cam surface which extends transversely to the longitudinal central axis of said retainer finger and a latch surface which extends transversely to said cam surface and to the longitudinal central axis of said latch finger, said body section of said retainer finger having a longitudinally extending central portion and first and second longitudinally extending side portions disposed along opposite sides of said central portion, said longitudinally extending central portion of said retainer finger having a greater thickness as viewed in a plane extending perpendicular to the longitudinal central axis of said retainer finger than said first and second longitudinally extending side portions of said retainer finger, said first series of contact cavities including a first contact cavity which is disposed adjacent to said first longitudinally extending side portion of said retainer finger and a second contact cavity which is disposed adjacent to said second longitudinally extending side portion of said retainer finger, said second connector section of said connector block assembly having first and second end surfaces which are interconnected by side surfaces, surface means defining a second series of contact cavities which extend between said first and second end surfaces of said second connector section to receive the second plurality of contacts, and surface means for defining a retainer cavity which extends inward from said first end surface of said second connector section of said connector block assembly and has a longitudinal central axis extending generally parallel to central axes of contact cavities of said second series of contact cavities, at least a portion of said retainer cavity having a longitudinally extending central portion and first and second longitudinally extending side portions disposed along opposite sides of said central portion of said retainer cavity, said longitudinally extending central portion of said retainer cavity having a greater thickness as viewed in a plane extending perpendicular to the longitudinal central axis of said retainer cavity than said first and second longitudinally extending side portions of said retainer cavity, said surface means for defining a retainer cavity including means for defining a latch flange which is disposed within said second connector section of said connector block assembly at a location between and spaced from said first and second end surfaces of said second connector section of said connector block assembly, said latch flange having a cam surface which extends transversely to the longitudinal central axis of said retainer cavity and a latch surface which extends transversely to said cam surface and to the longitudinal central axis of said retainer cavity, said cam surface on said head end section of said retainer finger being engageable with said cam surface on said latch flange to resiliently deflect said retainer finger during insertion of said retainer finger into said retainer cavity, said latch surface on said head end section of said retainer finger being disposed in abutting engagement with said latch surface on said latch flange when said retainer finger is inserted into said retainer cavity to block withdrawal of said retainer finger from said retainer cavity, said first series of contact cavities in said first connector section of said connector block assembly being aligned with said second series of contact cavities in said second connector section of said connector block assembly when said retainer finger is inserted in said retainer cavity, said second series of contact cavities including a first contact cavity which is disposed adjacent to said first longitudinally extending side portion of said retainer cavity and a second contact cavity disposed adjacent to said second longitudinally extending side portion of said retainer cavity, said central portion of said retainer cavity projecting from said first and second longitudinally extending side portions of said retainer cavity toward a location disposed between said first and second contact cavities in said second series of contact cavities.

37. A connector block assembly as set forth in claim 36 wherein said latch surface on said head end section of said retainer finger projects outward in a first direction from the longitudinal central axis of said retainer finger toward a plane containing central axes of said first and second contact cavities of said first series of contact cavities, said body section of said retainer finger having a first longitudinally extending side surface which faces in the first direction, said first longitudinally extending side surface of said body section of said retainer finger having a central portion with a continuously curving configuration as viewed in a plane extending perpendicular to the longitudinal central axis of said body section.

38. A connector block assembly as set forth in claim 37 wherein said latch surface on said head end section of said retainer finger has a central portion with a continuously curving configuration as viewed in a plane extending perpendicular to the longitudinal central axis of said body section, said continuously curving central portion of said latch surface on said head end section of said retainer finger having a configuration which corresponds to the configuration of the continuously curving central portion of said first longitudinally extending side surface of said body section.

39. A connector block assembly as set forth in claim 38 wherein said central portion of said first longitudinally extending side surface of said body section extends from said latch surface on said head end section of said retainer finger to said first end surface on said first connector section of said connector block assembly and has a continuously curving configuration as viewed in a plane extending perpendicular to the longitudinal central axis of said body section throughout its extent.

40. A connector block assembly as set forth in claim 37 wherein said first longitudinally extending side surface of said body section of said retainer finger has first and second side portions disposed along opposite sides of said central portion of said first longitudinally extending side surface of said body section of said retainer finger, said first and second side portions having linear configurations as viewed in a plane extending perpendicular to the longitudinal central axis of said body section.

41. A connector block assembly as set forth in claim 40 wherein said first and second side portions of said first longitudinally extending side surface of said body section of said retainer finger are disposed in a single flat plane, said central portion of said first longitudinally extending side surface of said body section extending in the first direction from the single flat plane toward the location disposed between said first and second contact cavities in said second series of contact cavities when the retainer finger is inserted in said retainer cavity.

42. A connector block assembly as set forth in claim 41 wherein said latch surface on said head end section of said retainer finger extends outward from said central portion and first and second side portions of said first longitudinally extending side surface of said body section in the first direction for the same distance throughout the extent of said latch surface on said head end section of said retainer finger and throughout the extent of said side surface of said body section.

43. A connector assembly as set forth in claim 37 wherein said retainer cavity has a side surface which extends parallel to a longitudinal central axis of said retainer cavity and faces toward the longitudinal central axis of said retainer cavity, said side surface of said retainer cavity having a central portion with a continuously curving configuration as viewed in a plane extending perpendicular to the longitudinal central axis of said retainer cavity, the continuously curving configuration of the central portion of said side surface of said retainer cavity corresponds to the continuously curving configuration of said first longitudinally extending side surface of said body section of said retainer finger.

44. A connector assembly as set forth in claim 43 wherein said latch surface on said latch flange has a central portion with a continuously curving configuration as viewed in a plane extending perpendicular to the longitudinal central axis of said retainer cavity, said continuously curving central portion of said latch surface on said latch flange having a configuration which corresponds to the configuration of said central portion of said side surface of said retainer cavity.

45. A connector assembly as set forth in claim 44 wherein said side surface of said retainer cavity extends from said latch surface on said latch flange to said second end surface of said second connector section of said connector block assembly.

46. A connector assembly as set forth in claim 45 wherein the distance from said latch surface on said latch flange to said second end surface of said second connector section of said connector block assembly is less than the distance from said latch surface on said latch flange to said first end surface of said second connector section of said connector block assembly.

47. A connector assembly as set forth in claim 43 wherein said side surface of said retainer cavity has first and second side portions disposed along opposite sides of said central portion of said side surface of said retainer cavity, said first and second side portions having linear configurations as viewed in a plane extending perpendicular to the longitudinal central axis of said retainer cavity.

48. A connector assembly as set forth in claim 36 wherein one of said first and second connector sections of said connector block assembly includes a plurality of alignment collars which are axially aligned with contact cavities in said one of said first and second connector sections and which project outward of said first end surface of said one of said first and second connector sections, another one of said first and second connector sections including a plurality of recesses which are axially aligned with contact cavities in said another one of said first and second connector sections and which extend inward of said first end surface of said another one of said first and second connector sections, said recesses in said another one of said first and second connector sections having configurations corresponding to the configuration of said alignment collars, said alignment collars being disposed in said recesses when said retainer finger is inserted in said retainer cavity.

49. A connector assembly as set forth in claim 36 wherein said body section of said retainer finger has a longitudinally extending side surface which extends from said latch surface on said head end section of said retainer finger to said first end surface on said first connector section of said connector block assembly, said first connector section of said connector block assembly including surface means for defining a slot which extends between said first and second end surfaces of said first connector section of said connector block assembly, said slot having a side surface which is aligned with and formed as a continuation of the longitudinally extending side surface on said retainer finger.

50. A connector block assembly as set forth in claim 49 wherein said slot is at least partially aligned with said retainer cavity and said latch flange in said retainer cavity when said retainer finger is inserted in said retainer cavity.

51. A connector block assembly as set forth in claim 36 wherein said first connector section of said connector block assembly further includes a second resiliently deflectable retainer finger extending outward from said first end surface of said first connector section and having a longitudinal central axis extending generally parallel to central axes of contact cavities of said first series of contact cavities, said second retainer finger having an elongated body section and a head end section, said head end section of said second retainer finger having a cam surface which extends transversely to the longitudinal central axis of said second retainer finger and a latch surface which extends transversely to the longitudinal central axis of said second retainer finger, said body section of said second retainer finger having a longitudinally extending central portion and first and second longitudinally extending side portions disposed along opposite sides of said central portion, said longitudinally extending central portion of said second retainer finger having a greater thickness as viewed in a plane extending perpendicular to the longitudinal central axis of said second retainer finger than said first and second longitudinally extending side portions of said second retainer finger, said first series of contact cavities including a third contact cavity which is disposed adjacent to said first longitudinally extending side portion of said second retainer finger and a fourth contact cavity which is disposed adjacent to said second longitudinally extending side portion of said second retainer finger, said second connector section of said connector block assembly further including surface means for defining a second retainer cavity which extends inward from said first end surface of said second section of said connector assembly and has a longitudinal central axis extending generally parallel to central axes of contact cavities of said second series of contact cavities, at least a portion of said second retainer cavity having a longitudinally extending central portion and first and second longitudinally extending side portions disposed along opposite sides of said central portion of said second retainer cavity, said longitudinally extending central portion of said second retainer cavity having a greater thickness as viewed in a plane extending perpendicular to the longitudinal central axis of said second retainer cavity than said first and second longitudinally extending side portions of said second retainer cavity, said surface means for defining a second retainer cavity including means for defining a second latch flange which is disposed within said second connector section of said connector block assembly at a location between and spaced from said first and second end surfaces of said second connector section of said connector block assembly, said second series of contact cavities including a third contact cavity which is disposed adjacent to said first longitudinally extending side portion of said second retainer cavity and a fourth contact cavity which is disposed adjacent to said second longitudinally extending side portion of said second retainer cavity, said central portion of said second retainer cavity projecting from said first and second longitudinally extending side portions of said second retainer cavity toward a location disposed between said third and fourth contact cavities in said second series of contact cavities.

52. A connector block assembly for use in connecting a first plurality of electrical conductors with a second plurality of electrical conductors, said connector block assembly comprising a first connector section which receives a first plurality of contacts which are associated with the first plurality of electrical conductors, and a second connector section which receives a second plurality of contacts which are associated with the second plurality of electrical conductors, said first connector section of said connector block assembly having first and second end surfaces which are interconnected by outer side surfaces, surface means for defining a first array of contact cavities which extend between said first and second end surfaces of said first connector section to receive the first plurality of contacts, and first and second resiliently deflectable retainer fingers extending outward from said first end surface of said first connector section and having longitudinal central axes extending generally parallel to central axes of contact cavities of said first series of contact cavities, each one of said retainer fingers having an elongated body section and a head end section, said head end section of each one of said retainer fingers having a cam surface which extends transversely to the longitudinal central axis of said one retainer finger and a latch surface which extends transversely to said cam surface and to the longitudinal central axis of said one latch finger, said latch surface on said head end section of said first retainer finger extending perpendicular to a first side surface on said body section of said first retainer finger, said latch surface on said head end section of said second retainer finger extending perpendicular to a first side surface on said body section of said second retainer finger, said first connector section of said connector block assembly including first surface means for defining a first slot which is disposed within said first array of contact cavities and extends between said first and second end surfaces of said first connector section, said first slot being spaced from the outer side surfaces of said first connector section throughout the extent of said first slot, said first slot having a first side surface which is aligned with and formed as a continuation of the first side surface on said body section of said first retainer finger, said first connector section of said connector block assembly including second surface means for defining a second slot which is disposed within said first array of contact cavities and extends between said first and second end surfaces of said first connector section, said second slot being spaced from the outer side surfaces of said first connector section throughout the extent of said second slot, said second slot having a first side surface which is aligned with and formed as a continuation of the first side surface on said body section of said second retainer finger, said latch surface on said head end section of said first retainer finger facing toward and being aligned with an opening to said first slot formed in said first end surface of said first connector section, said latch surface on said head end section of said second retainer finger facing toward and being aligned with an opening to said second slot formed in said first end surface of said first connector section, said second connector section of said connector block assembly having first and second end surfaces which are interconnected by outer side surfaces, surface means defining a second array of contact cavities which extend between said first and second end surfaces of said second connector section to receive the second plurality of contacts, and surface means for defining first and second retainer cavities which are disposed within said second array of contact cavities and extend inwardly from said first end surface of said second connector section of said connector block assembly and have longitudinal central axes extending generally parallel to central axes of contact cavities of said second array of contact cavities, said first and second retainer cavities being spaced apart from each other and from the outer side surfaces of said second connector section throughout the extent of said first and second retainer cavities, said surface means for defining said first and second retainer cavities including means for defining a latch flange in each of said retainer cavities, each one of said latch flanges being disposed within said second connector section of said connector block assembly at a location between and spaced from said first and second end surfaces of said second connector section of said connector block assembly, each one of said latch flanges having a cam surface which extends transversely to longitudinal central axes of said retainer cavities and a latch surface which extends transversely to said cam surfaces on said latch flanges and to the longitudinal central axes of said retainer cavities, said latch surfaces on each of said latch flanges being disposed within said second array of contact cavities and spaced apart from the outer side of said second connector section, said cam surfaces on said head end sections of said first and second retainer fingers being engageable with said cam surfaces on said latch flanges to resiliently deflect said first and second retainer fingers during insertion of said first and second retainer fingers into said first and second retainer cavities, said latch surfaces on said head end sections of said first and second retainer fingers being disposed in abutting engagement with said latch surfaces on said latch flanges when said first and second retainer fingers are inserted into said first and second retainer cavities to block withdrawal of said first and second retainer fingers from said first and second retainer cavities.

53. A connector block assembly as set forth in claim 52 wherein at least a portion of said first side surface on said body section of first retainer finger and at least a portion of said first side surface of said first slot have a curving configuration as viewed in a plane extending parallel to said latch surface on said head end section of said first retainer finger, at least a portion of said first side surface on said body section of said second retainer finger and at least a portion of said first side surface of said second slot having a curving configuration as viewed in a plane extending parallel to said latch surface on said head end section of said second retainer finger.

54. A connector assembly as set forth in claim 52 wherein said body section of said first retainer finger has a longitudinally extending central portion and longitudinally extending side portions disposed along opposite sides of said central portion, said longitudinally extending central portion of said first retainer finger having a greater thickness than said longitudinally extending side portions of said first retainer finger, said body section of said second retainer finger having a longitudinally extending central portion and longitudinally extending side portions disposed along opposite sides of said central portion, said longitudinally extending central portion of said second retainer finger having a greater thickness than said longitudinally extending side portions of said second retainer finger.

55. A connector assembly as set forth in claim 52 wherein one of said first and second connector sections of said connector block assembly includes a plurality of alignment collars which are axially aligned with contact cavities in said one of said first and second connector sections and which project outward of said first end surface of said one of said first and second sections, another one of said first and second connector sections including a plurality of recesses which are axially aligned with contact cavities in said another one of said first and second connector sections and which extend inward of said first end surface of said another one of said first and second sections, said recesses in said another one of said first and second connector sections having configurations corresponding to the configuration of said alignment collars, said alignment collars being disposed in said recesses when said first and second retainer fingers are inserted in said retainer cavities.

56. A connector block assembly as set forth in claim 52 wherein said latch surfaces on said head end sections of said retainer fingers project outward toward each other from the longitudinal central axes of said retainer fingers, said body sections of said retainer fingers having first longitudinally extending side surfaces which face toward each other, said first longitudinally extending side surfaces of said body sections of said retainer fingers having central portions with a continuously curving configuration as viewed in planes extending perpendicular to the longitudinal central axes of said body sections, said first side surface of said first and second slots having central portions with continuously curving configurations which correspond to the continuously curving configurations of said central portions of said side surfaces of said body sections of said retainer fingers.

57. A connector block assembly as set forth in claim 56 wherein said latch surfaces on said head end sections of said retainer fingers have central portions with continuously curving configuration as viewed in a plane extending perpendicular to the longitudinal central axes of said body sections, said continuously curving central portions of said latch surfaces on said head end sections of said retainer fingers having configurations which correspond to the configurations of the continuously curving central portions of said first longitudinally extending side surfaces of said body sections.

58. A connector block assembly as set forth in claim 56 wherein each of said first longitudinally extending side surfaces of said body sections of said retainer fingers have first and second side portions disposed along opposite sides of said central portions of said first longitudinally extending side surfaces of said body section of said retainer fingers, said first and second side portions of each of said longitudinally extending side surfaces having linear configurations as viewed in a plane extending perpendicular to the longitudinal central axis of said body sections.

59. A connector block assembly as set forth in claim 58 wherein said first and second side portions of said first longitudinally extending side surfaces of each of said body sections of said retainer fingers are disposed in a single flat plane.

60. A connector assembly as set forth in claim 52 wherein one of said first and second connector sections of said connector block assembly includes a plurality of alignment collars which are axially aligned with contact cavities in said one of said first and second connector sections and which project outward of said first end surface of said one of said first and second connector sections, another one of said first and second connector sections including a plurality of recesses which are axially aligned with contact cavities in said another one of said first and second connector sections and which extend inward of said first end surface of said another one of said first and second connector sections, said recesses in said another one of said first and second connector sections having configurations corresponding to the configuration of said alignment collars, said alignment collars being disposed in said recesses when said retainer fingers are inserted in said retainer cavities.

61. A connector block assembly for use in connecting a first plurality of electrical conductors with a second plurality of electrical conductors, said connector block assembly comprising a first connector section which is formed as one piece and receives a first plurality of contacts which are associated with the first plurality of electrical conductors, and a second connector section which is formed as one piece and receives a second plurality of contacts which are associated with the second plurality of electrical conductors, said first connector section having first and second end surfaces which are interconnected by outer side surfaces, surface means for defining a first array of contact cavities which extend between said first and second end surfaces of said first connector section to receive the first plurality of contacts, and first and second resiliently deflectable retainer fingers extending outward from said first end surface of said first connector section and having longitudinal central axes extending generally parallel to central axes of contact cavities of said first array of contact cavities, said first and second resiliently deflectable retainer fingers being connected with said first connector section at locations which are spaced from said outer side surfaces of said first connector section, each one of said retainer fingers having an elongated body section and a head end section, said elongated body sections of said first and second retainer fingers having inner side surfaces which face toward each other and outer side surfaces which faces away from each other and face toward outer side surfaces of said first connector section, said head end section of each one of said retainer fingers having a cam surface which extends transversely to the longitudinal central axis of said one retainer finger and a latch surface which extends transversely to said cam surface and to the longitudinal central axis of said one latch finger, said first and second retainer fingers having longitudinal central axes which extend through said first array of contact cavities, said second connector section having first and second end surfaces which are interconnected by outer side surfaces, surface means defining a second array of contact cavities which extend between said first and second end surfaces of said second connector section to receive the second plurality of contacts, and surface means for defining first and second retainer cavities which extend inward from said first end surface of said second connector section and have longitudinal central axes extending generally parallel to central axes of contact cavities of said second series of contact cavities, said first and second retainer cavities being spaced apart from outer side surfaces of said second connector section and said second connector section and being disposed within said second array of contact cavities, said surface means for defining said first and second retainer cavities including means for defining a latch flange in each of said retainer cavities, each of said latch flanges being disposed within said second connector section at a location between and spaced from said first and second end surfaces of said second connector section, each of said latch flanges being spaced apart from outer side surfaces of said second connector section and being disposed within said second array of connector cavities, each of said latch flanges having a cam surface which extends transversely to longitudinal central axes of said retainer cavities and a latch surface which extends transversely to said cam surfaces on said latch flanges and to the longitudinal central axes of said retainer cavities, said cam surfaces on said head end sections of said first and second retainer fingers being engageable with said cam surfaces on said latch flanges to resiliently deflect said first and second retainer fingers during insertion of said first and second retainer fingers into said first and second retainer cavities, said latch surfaces on said head end sections of said first and second retainer fingers being disposed in abutting engagement with said latch surfaces on said latch flanges when said first and second retainer fingers are inserted into said first and second retainer cavities to block withdrawal of said first and second retainer fingers from said first and second retainer cavities, one of said first and second connector sections of said connector block assembly including a plurality of alignment collars which are axially aligned with contact cavities in said one of said first and second connector sections and which project outwardly of said first end surface of said one of said first and second connector sections, each of said alignment collars being formed as one piece with said one of said first and second connector sections and being spaced apart from outer side surfaces of said one of said first and second connector sections, another one of said first and second connector sections including a plurality of recesses which are axially aligned with contact cavities in said another one of said first and second connector sections and which extend inward of said first end surface of said another one of said first and second connector sections, said recesses in said another one of said first and second connector sections having configurations corresponding to the configuration of said alignment collars, said alignment collars being disposed in said recesses when said retainer fingers are inserted in said retainer cavity, a first plurality of said alignment collars being disposed between said inner side surfaces on said first and second retainer fingers when said alignment collars are disposed in said recesses, a second plurality of said alignment collars being disposed between said outer side surface on said first retainer finger and an outer side surface of said another one of said first and second connector sections when said alignment collars are disposed in said recesses, and a third plurality of said alignment collars being disposed between said outer side surface on said second retainer finger and an outer side surface of said another one of said first and second connector sections when said alignment collars are disposed in said recesses.

62. A connector block assembly as set forth in claim 61 wherein at least some of said alignment collars are disposed on said first connector section of said connector block assembly at a location between said first and second retainer fingers, at least some of said recesses being disposed in said second connector section of said connector block assembly at a location between said first and second retainer cavities.

63. A connector block assembly as set forth in claim 61 wherein said outer side surface on said body section of said first retainer finger defines a plurality of longitudinally extending recesses, each of said recesses having an arcuate configuration as viewed in a plane extending perpendicular to the longitudinal central axis of said body section of said first retainer finger with a center of curvature disposed on a longitudinal central axis of one of said contact cavities of said first series of contact cavities.

64. A connector assembly as set forth in claim 61 wherein said first connector section of said connector block assembly includes surface means for defining a plurality of slots which extend between said first and second end surfaces of said first connector section of said connector block assembly, said slots being disposed within said first array of contact cavities, each of said slots having a side surface which is aligned with and formed as a continuation of the inner side surface on one of said first and second retainer fingers.

65. A connector assembly as set forth in claim 61 wherein said head end sections of said first and second retainer fingers are entirely disposed within said first and second retainer cavities when said first and second retainer fingers are inserted in said first and second retainer cavities.

66. A connector assembly as set forth in claim 61 wherein each of said latch surfaces on said head end sections of said first and second retainer fingers has a central portion with a curving configuration as viewed in a plane extending perpendicular to a longitudinal central axis of said first connector section of said connector assembly, each of said latch surfaces on said head end sections of said first and second retainer fingers having first and second side portions disposed at opposite sides of said central portion and having linear configurations as viewed in the plane extending perpendicular to a longitudinal central axis of said first section of said connector assembly.

* * * * *

UNITED STATES PATENT AND TRADEMARK OFFICE

CERTIFICATE OF CORRECTION

PATENT NO. : 5,389,007

DATED : February 14, 1995

INVENTOR(S) : Ernest Reinelt

It is certified that error appears in the above-indentified patent and that said Letters Patent is hereby corrected as shown below:

Column 29, line 35, after "side" insert --surfaces--.

Signed and Sealed this

Eighteenth Day of July, 1995

*Attest:*

Bruce Lehman

BRUCE LEHMAN

*Attesting Officer*

*Commissioner of Patents and Trademarks*